US011337534B2

(12) United States Patent
Silsby et al.

(10) Patent No.: US 11,337,534 B2
(45) Date of Patent: May 24, 2022

(54) DRINK CONTAINER AND LEAK PROOF PLUG LID FOR USE THEREWITH

(71) Applicant: Pacific Market International, LLC, Seattle, WA (US)

(72) Inventors: Jacob D. Silsby, Seattle, WA (US); Ping The Phan, Shoreline, WA (US)

(73) Assignee: Pacific Market International, LLC, Seattle, WA (US)

( * ) Notice: Subject to any disclaimer, the term of this patent is extended or adjusted under 35 U.S.C. 154(b) by 128 days.

(21) Appl. No.: 16/418,800

(22) Filed: May 21, 2019

(65) Prior Publication Data

US 2020/0367677 A1 Nov. 26, 2020

(51) Int. Cl.
*A47G 19/22* (2006.01)
*B65D 43/02* (2006.01)

(52) U.S. Cl.
CPC ..... *A47G 19/2272* (2013.01); *B65D 43/0202* (2013.01); *B65D 2543/00046* (2013.01); *B65D 2543/0049* (2013.01); *B65D 2543/00092* (2013.01); *B65D 2543/00231* (2013.01); *B65D 2543/00546* (2013.01); *B65D 2543/00972* (2013.01)

(58) Field of Classification Search
CPC ..... B65D 2543/00046; B65D 2543/00092; B65D 2543/00231; B65D 2543/0049; B65D 2543/00546; B65D 2543/00972; B65D 43/0202; B65D 45/327; B65D 55/12; A47G 19/2272
USPC ..... 215/262; 220/234, 260, 714
See application file for complete search history.

(56) References Cited

U.S. PATENT DOCUMENTS

| | | | | |
|---|---|---|---|---|
| 2,199,964 | A | 5/1940 | Rook | |
| 2,685,380 | A | 8/1954 | Moeller | |
| 4,930,657 | A | 6/1990 | Walker | |
| 6,443,336 | B2 * | 9/2002 | Antonetti | B65D 47/244 222/509 |
| 8,186,527 | B2 | 5/2012 | Liu | |

(Continued)

FOREIGN PATENT DOCUMENTS

| | | | |
|---|---|---|---|
| AU | 440884 | B2 | 9/1973 |
| DE | 78568 | C | 7/1893 |

(Continued)

OTHER PUBLICATIONS

Camelback Brook, 7 pages, product publicly disclosed on year prior to May 21, 2019.

(Continued)

*Primary Examiner* — Don M Anderson
*Assistant Examiner* — Madison L Poos
(74) *Attorney, Agent, or Firm* — George C. Rondeau, Jr.; Davis Wright Tremaine LLP

(57) ABSTRACT

A drink container and plug lid for use therewith. The lid has an upper member and a lower member with a ring seal positioned therebetween and radially outwardly stretchable from an initial diameter to a larger sealing diameter in response to an actuator moving the upper and lower members together to place the ring seal in fluid-tight sealing engagement with the container body. Moving the upper and lower members apart allows the radially outward stretched ring seal to move from the sealing diameter to the initial diameter whereat it is out of fluid-tight sealing engagement with the container body.

61 Claims, 30 Drawing Sheets

(56) References Cited

U.S. PATENT DOCUMENTS

| | | | | |
|---|---|---|---|---|
| 9,708,108 | B2 * | 7/2017 | Gregory | B65D 47/249 |
| 2010/0200602 | A1 * | 8/2010 | Chan | A47G 19/2272 220/714 |
| 2013/0037540 | A1 * | 2/2013 | Sze | B65D 43/022 220/237 |
| 2013/0313219 | A1 * | 11/2013 | Pao | B65D 53/02 215/262 |
| 2018/0050846 | A1 | 2/2018 | Shao | |

FOREIGN PATENT DOCUMENTS

| | | | |
|---|---|---|---|
| DE | 517386 | C | 2/1931 |
| DE | 1532446 | A1 | 6/1970 |
| DE | 3312915 | A1 | 10/1984 |

OTHER PUBLICATIONS

Revomax Twist Free, 3 pages, product publicly disclosed on year prior to May 21, 2019.

* cited by examiner

DRINK CONTAINER AND LEAK PROOF PLUG LID FOR USE THEREWITH

FIELD OF INVENTION

The present invention relates to drink containers and removable lids for use therewith, and more precisely to plug lids.

BACKGROUND

Drink containers or drinking vessels with lids having sealing mechanisms are known in the art. Many require the lid to be threadably attached to a drink container body. One disadvantage of threadably attached lids is the time, effort and motion required to attach or remove the lid from the drink container body, and also the difficulty of doing so in some situations. Known plug lids overcome some of these issues, but generally do not permit drinking from the drinking container unless the plug lid is fully removed from the drinking container. A sealing problem exists with some plug lid designs when used with drink container bodies having variations in the interior diameter of the bodies, thus requiring a lid with a wide size tolerance to insure a good fluid-tight seal with the interior wall of the container body.

DETAILED DESCRIPTION

Figure 1:
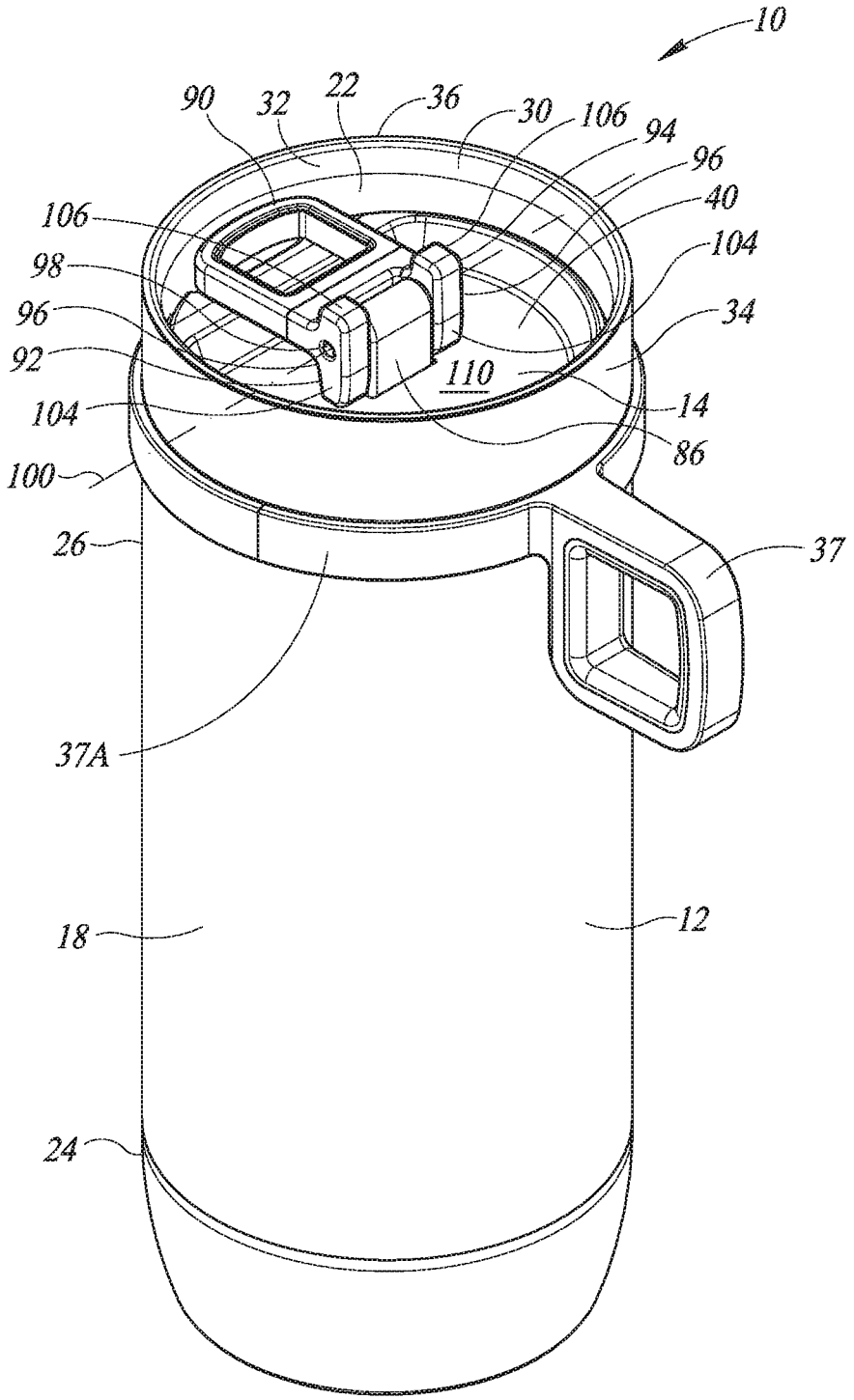
FIG. 1 is a top perspective view of a drink container with a plug lid in a first operational position.
Figure 1A:
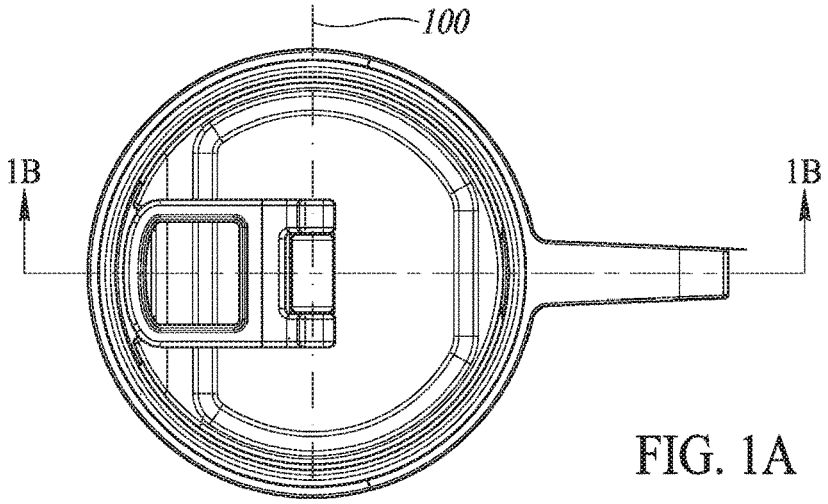
FIG. 1A is a top plan view of the drink container of FIG. 1.

A drinking vessel or drink container 10 in accordance with the present embodiment is shown in FIGS. 1-8. The drink container 10 includes a substantially cylindrical body 12 and a lid 14. The illustrated body 12 has a double wall construction for improved thermal insulation, using an inner body 16 positioned and secured within an outer body 18. In other embodiments not shown, a single wall construction may be used.

The inner body 16 has a lower inner body portion 20 and an upper inner body portion 22 forming a hollow interior chamber 19. The outer body 18 has a lower outer body portion 24 and an upper outer body portion 26. A drinkable liquid (not shown) may be stored in the lower inner body portion 20 when the drink container 10 is in an upright position. The upper inner body portion 22 defines an interior fluid passageway 28 having a longitudinal axis 29, and an upper end opening 30 at an upper end of the body 12 through which the liquid stored in lower inner body portion 20 may flow for drinking or pouring when the drink container 10 is sufficiently tilted. An upper end portion 32 of the upper inner body portion 22 and an upper end portion 34 of the upper outer body portion 26 are joined at their upper ends to define a drinking lip 36 at the upper end of the body 12 which the lips of a user may be placed for drinking the liquid stored in lower inner body portion 20 when the drink container 10 is sufficiently tilted. A handle 37 is attached to the body 12 by a ring portion 37A which extends about the upper outer body portion 26 to facilitate the user holding the drink container 10.

The upper inner body portion 22 has an interior, circumferentially extending body inward protrusion or body ridge 38 projecting inward within the fluid passageway 28. The body ridge 38 extends continuously about the circumference of the upper inner body portion 22. The body ridge 38 has a circumferentially extending upper wall portion 38A which slopes downward in the inward direction, and a circumferentially extending lower wall portion 38B which slopes upward in the inward direction. As will be described, the body ridge 38 serves as a stop to support the lid 14 when within the fluid passageway 28 and limit its downward movement within the fluid passageway. In alternative embodiments not illustrated, the body ridge 38 may not be continuous.

The lid 14 is a plug-type closure which is insertable by the user into the fluid passageway 28 through the upper end opening 30 for use of the drink container 10 for storing, transporting and drinking a liquid, and removable therefrom when desired by the user for washing the lid and/or body 12 of the drink container. The lid 14 may be operated to move between three states, a closed and securely retained state as shown in FIGS. 1, 1A, 1B and 1C, an opened but retained state as shown in FIGS. 2, 2A, 2B and 2C, and an opened and removable state as shown in FIGS. 3, 3A, 3B, 3C, 4 and 5. In the closed and securely retained state shown in FIGS. 1, 1A, 1B and 1C, the fluid passageway 28 is closed so no liquid can be drunk from the drink container 10 and the lid 14 cannot be removed from the body 12 (or inserted into the fluid passageway). In the opened but retained state shown in FIGS. 2, 2A, 2B and 2C, the lid 14 is opened for drinking but retained within the fluid passageway 28 against unintended removal. In the opened and removable state shown in FIGS. 3, 3A, 3B, 3C, 4 and 5, the lid 14 is opened but not retained within the fluid passageway 28 so as to be removable by the user for filling the lower inner body portion 20 with a liquid or for washing the lid and/or the body 12. The individual component parts of the drink container 10 are separately illustrated in the exploded views of FIGS. 6, 7 and 8.

The lid 14 includes an upper seal carrier 40, a lower seal carrier 42 and a flexible tubular seal 44. The upper seal carrier 40 has an upper portion 40A and a smaller diameter lower portion 40B. The upper portion 40A of the upper seal carrier 40 is sized to engage and be supported by the body ridge 38 when the lid 14 is inserted by the user into the fluid passageway 28 through the upper end opening 30, while the lower seal carrier 42 is smaller and sized to pass by the body ridge 38 and reside within the fluid passageway below the body ridge. When the lid 14 is positioned within the fluid passageway 28, the upper seal carrier 40, the lower seal carrier 42 and tubular seal 44 are coaxially arranged within the fluid passageway 28. The upper seal carrier 40 and the lower seal carrier 42 are axially spaced apart and each extend transverse to the longitudinal axis 29. As will be described in greater detail below, the lower seal carrier 42 is axially movable relative to the upper seal carrier 40 within the fluid passageway 28.

The tubular seal 44 has the shape of a bellows with a single convolution and may be made of a soft silicon material. The tubular seal 44 has a circumferential upper end portion 46 sealingly attached to the upper seal carrier 40 and a circumferential lower end portion 48 sealingly attached to the lower seal carrier 42. The tubular seal 44 has a thin perimeter sidewall 44A and a hollow interior space 44B located within the perimeter sidewall and extending the full length of the tubular seal upper and lower end portions 46 and 48. The interior space 44B spans a substantial portion of the interior cross-sectional area of the fluid passageway 28, in the illustrated embodiment when in the opened and removable state shown in FIGS. 3, 3A, 3B, 4 and 5, the interior space spans approximately 93% of the interior cross-sectional area of the fluid passageway, and preferably spans at least 50% of the interior cross-sectional area of the fluid passageway. While the tubular seal 44 is illustrated as having a generally tubular shaped flexible perimeter sidewall 44A and the hollow interior space 44B as extending fully between its upper and lower end portions 46 and 48, the sidewall and interior space may have other shapes and configurations.

When the lid 14 is positioned within the within the fluid passageway 28, the upper portion 40A of the upper seal carrier 40 is positioned above and in engagement with an upper portion of the body ridge 38 of the upper inner body portion 22 of the body 12, which supports the upper seal carrier and prevents further downward movement of the lid within the fluid passageway. When the lid 14 is so positioned, a perimeter sidewall 50 of the upper portion 40A of the upper seal carrier 40 is positioned adjacent to an upper interior wall surface portion 52 of the upper inner body portion 22, except for a drink dispensing aperture 54 formed by an inwardly recessed region at the perimeter of the upper portion of the upper seal carrier through which liquid may pass for drinking when the drink container 10 is sufficiently tilted and the lid is in the opened but retained state as shown in FIGS. 2, 2A, 2B and 2C, or the opened and removable state as shown in FIGS. 3, 3A, 3B and 3C (although when in the opened and removable state the lid is not securely retained within the fluid passageway).

When the lid 14 is positioned within the fluid passageway 28 with the upper portion 40A of the upper seal carrier 40 positioned above and engagement with the body ridge 38, a perimeter sidewall 56 of the lower seal carrier 42 is positioned inward away from a lower interior wall surface portion 58 of the upper inner body portion 22. This forms a circumferentially extending, perimeter fluid flow pathway 60 between the perimeter sidewall 56 and the lower interior wall surface 58 through which liquid may pass for drinking when the drink container 10 is sufficiently tilted.

The lower portion 40B of the upper seal carrier 40 has a perimeter sidewall 62 and is positioned within an upper edge portion 64 of the upper end portion 46 of the tubular seal 44. The perimeter sidewall 62 of the lower portion 40B of the upper seal carrier 40 has a circumferential extending outward facing protrusion 66 over which the upper edge portion 64 of the tubular seal 44 extends to position the protrusion 66 in a circumferentially extending inward facing groove 68 of the upper edge portion to sealingly secure the upper edge portion to the upper seal carrier 40.

The perimeter sidewall 50 of the upper portion 40A of the upper seal carrier 40 has a circumferentially extending outward facing groove 70 in which a circumferentially extending seal 72 is positioned to provide a fluid-tight seal between the upper seal carrier 40 and the upper interior wall surface portion 52 of the upper inner body portion 22 when the lid 14 is positioned within the within the fluid passageway 28, except at the drink dispensing aperture 54.

The lower seal carrier 42 is positioned at least partially within a lower edge portion 74 of the lower end portion 48 of the tubular seal 44. The perimeter sidewall 56 of the lower seal carrier 42 includes a circumferentially extending outward facing slot 76 in which an end portion 75 of the lower edge portion 74 is positioned and secured to sealingly secure the lower edge portion 74 to the lower seal carrier 42.

A midportion 77 of the tubular seal 44 has a circumferentially, outwardly projecting extending bulge which is mostly positioned below the upper seal carrier 40 and the body ridge 38. The midportion 77 has a circumferentially extending upper wall portion 77A and a circumferentially extending lower wall portion 77B. When the midportion 77 is compress by moving the lower seal carrier 42 upward to be closer to the upper seal carrier 40, as will be described in greater detail below, the upper and lower wall portions 77A and 77B move closer together, and the upper wall portion 77A moves closer to the body ridge 38. In the closed and securely retained state shown in FIGS. 1, 1A, 1B and 1C, the upper wall portion 77A is pressed against the body ridge 38 to provide a fluid-tight seal therebetween and close the fluid passageway 28, thus preventing fluid stored in the lower inner body portion 20 from flowing upward through the fluid pathway 60 to the drink dispensing aperture 54 even when the drinking container is tilted. In the illustrated embodiment, the upper wall portion 77A presses against the lower wall portion 38B of the body ridge 38.

A connector member 78 has an exteriorly threaded base portion 79 which is threadably received in an interiorly threaded central opening 80 of the lower seal carrier 42 for axial movement of the connector member with axial movement of the lower seal carrier. The connector member 78 has a lifter member 82 located inward of the perimeter sidewall 44A of the tubular seal and within the interior space 44B, and which projects axially upward from the lower seal carrier 42 and through a central aperture 84 in the upper seal carrier 40. An upper end portion 86 of the lifter member 82 extends above the upper seal carrier 40 and has a transverse lifter member bore 88.

A cam member 90 is positioned about the upper seal carrier 40 and has a pair of spaced apart cam portions 92 and 94 located at a lower end thereof. The upper end portion 86 of the lifter member 82 is positioned between the cam portions 92 and 94. The cam portions 92 and 94 each have a transverse cam portion bore 96 which axially aligns with the lifter member bore 88. A pivot pin 98 extends through the cam portion bores 96 and the lifter member bore 88 to rotatably attach the cam member 90 to the upper end portion 86 of the lifter member 82 to permit rotation of the cam member 90 about a transverse axis of rotation 100.

The cam member 90 has a handle portion 102 to which the cam portions 92 and 94 of the cam member are rigidly attached for rotation with the handle portion. Each of the cam portions 92 and 94 has a first cam 104 and a second cam 106 extending in opposite directions away from the handle portion 102 transverse to the pivot pin 98, with both of the first cams 104 extending to one side of the handle portion and both of the second cams 106 extending to an opposite side of the handle portion. The first cam 104 is longer than the second cam 106 to provide a greater amount of lift than the second cam. The handle portion 102 is rotatable about the pivot pin 98 between a first rotational/operational position shown in FIGS. 1, 1A, 1B and 1C, a second rotational/operational position shown in FIGS. 2, 2A, 2B and 2C, and a third rotational/operational position shown in FIGS. 3, 3A, 3B and 3C. The third rotational/operational position of the handle portion 102 is located between the first and second rotational/operational positions of the handle portion. Rotation of the handle portion 102 directly produces rotation of the first and second cams 104 and 106. The handle portion 102 projects away from the cam portions 92 and 94 and provides a grip for grasping by a user for rotation of the cam member 90 about the pivot pin 98 and rotation of the handle portion 102 between its first, second and third rotational/operational positions. The handle portion 102 has a central aperture 108 sized to allow at least one finger of the user to fit therethrough to facilitate grasping of the handle portion for rotation of the cam member 90 or for removal of the lid 14 from the fluid passageway 28 and insertion of the lid into the fluid passageway.

Figure 3:
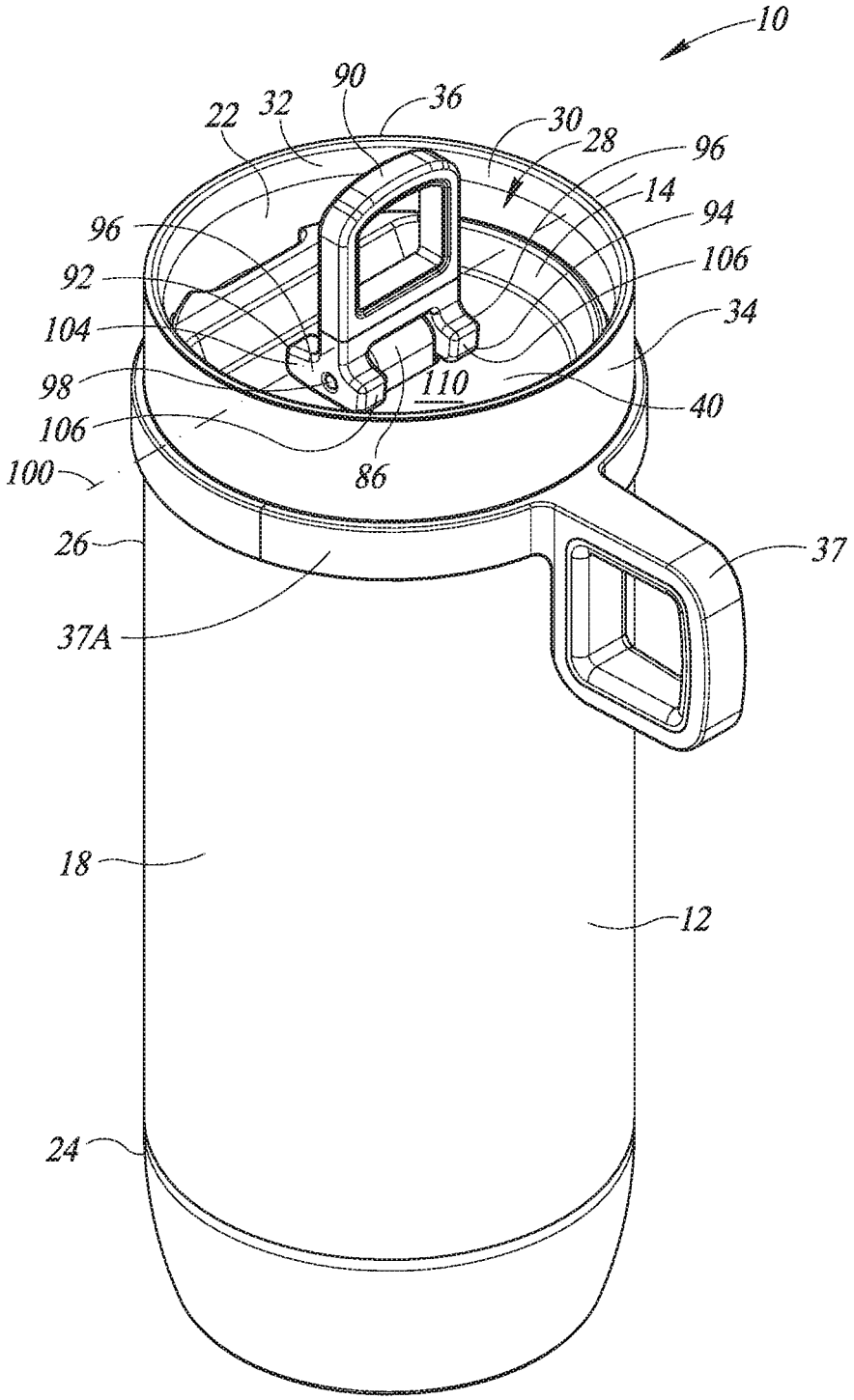
FIG. 3 is a top perspective view of the drink container lid of FIG. 1 with the plug lid in a third operational position.
Figure 3A:
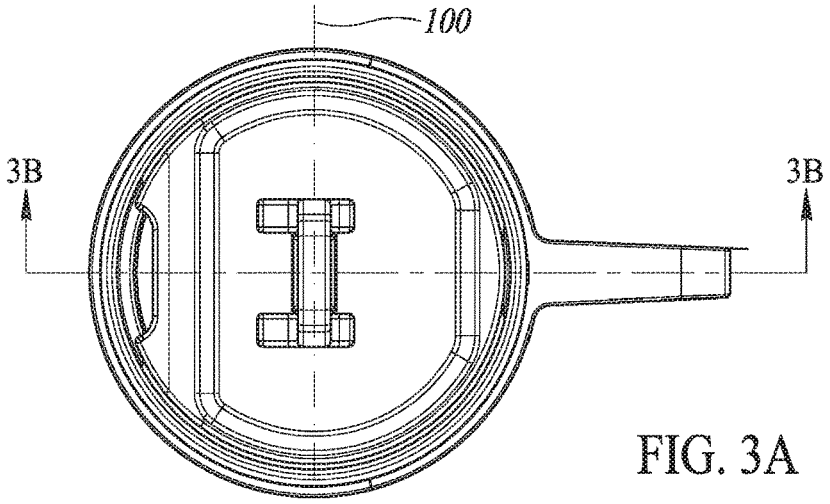
FIG. 3A is a top plan view of the drink container lid of FIG. 3.
Figure 3B:
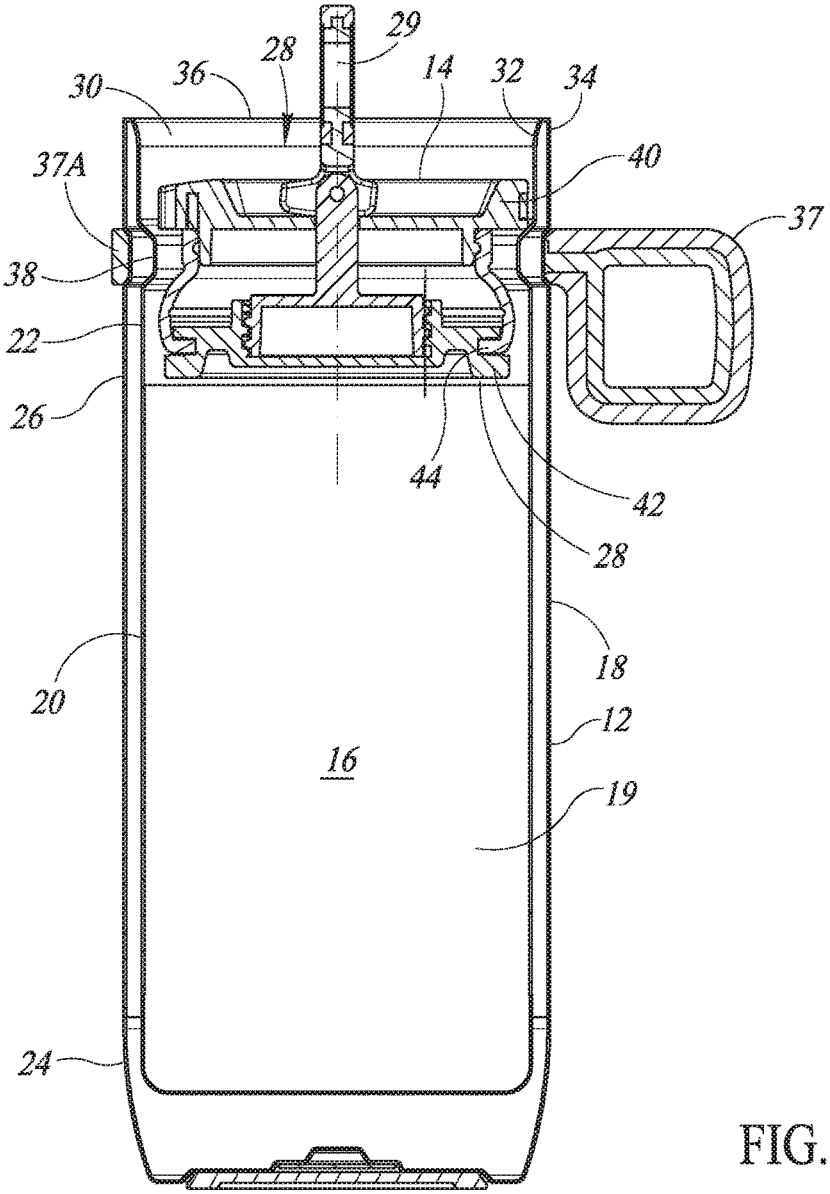
FIG. 3B is a cross-sectional view of the drink container lid of FIG. 3 taken substantially along the line 3B-3B of FIG. 3A.
Figure 3C:
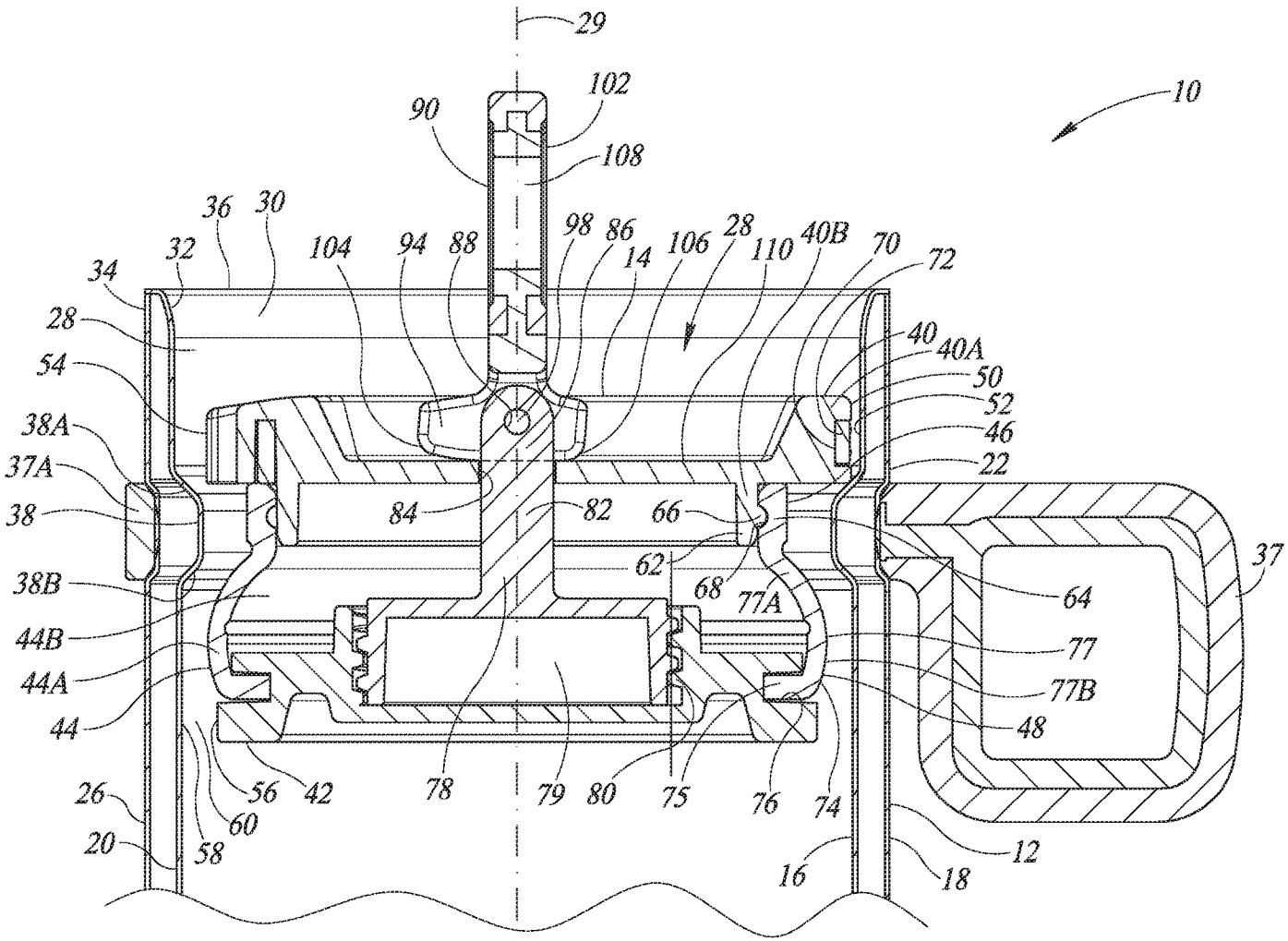
FIG. 3C is a partial enlargement of FIG. 3B.
Figure 4:
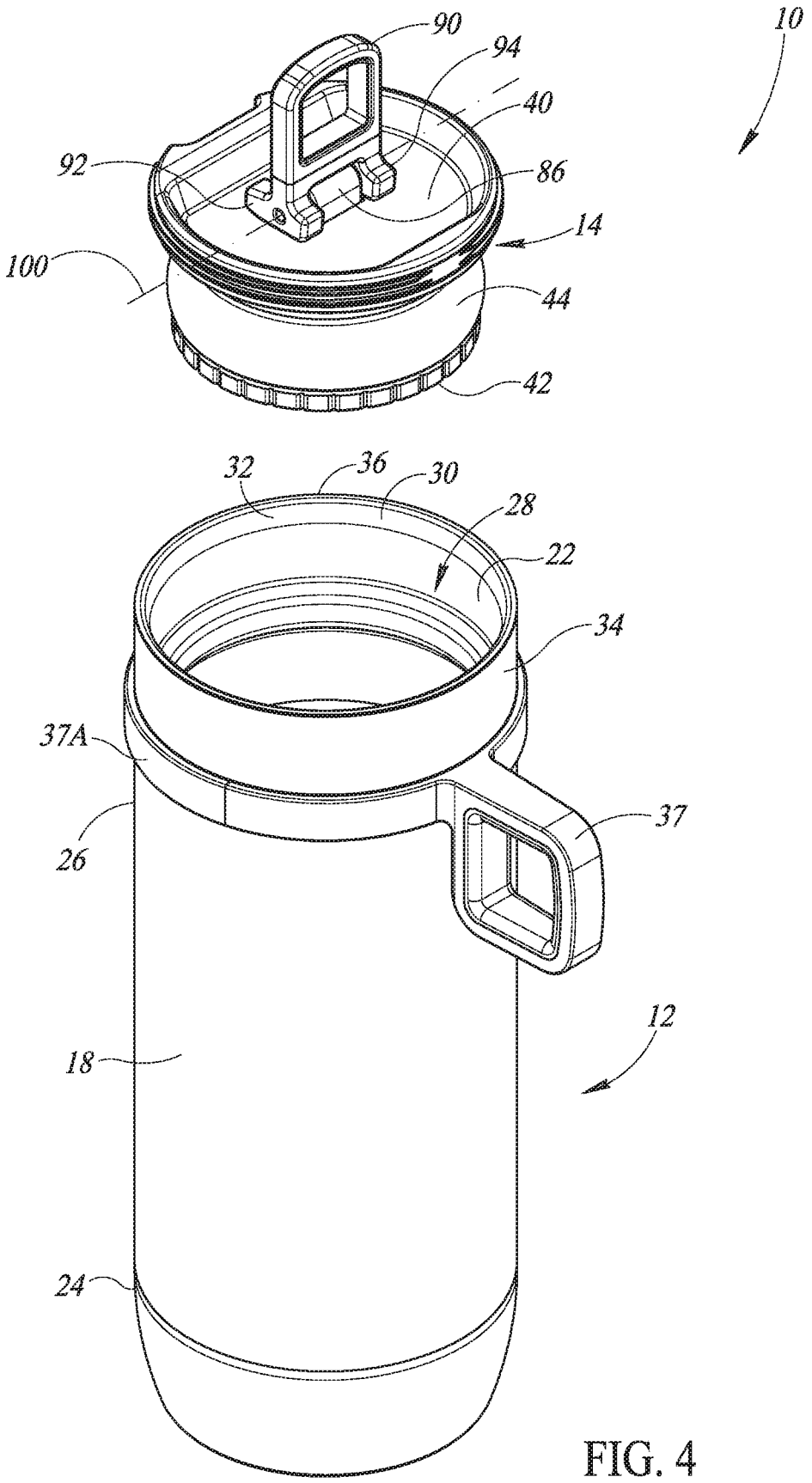
FIG. 4 is a top perspective view of the drink container of FIG. 1 with the plug lid in the third operational position shown in FIG. 3 and removed from a body of the drinking container.
Figure 5:
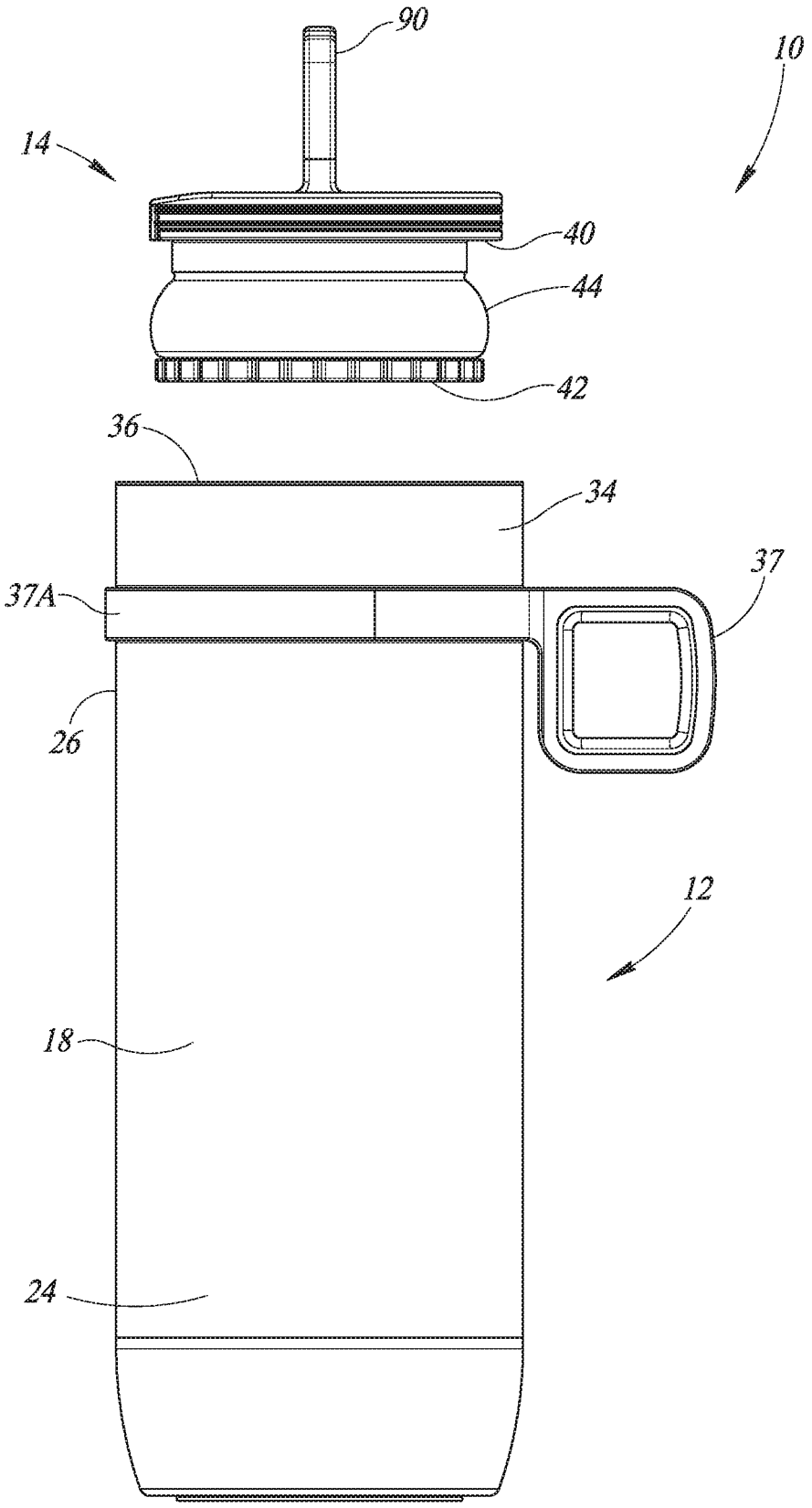
FIG. 5 is a left side elevational view of the drink container of FIG. 4.
Figure 6:
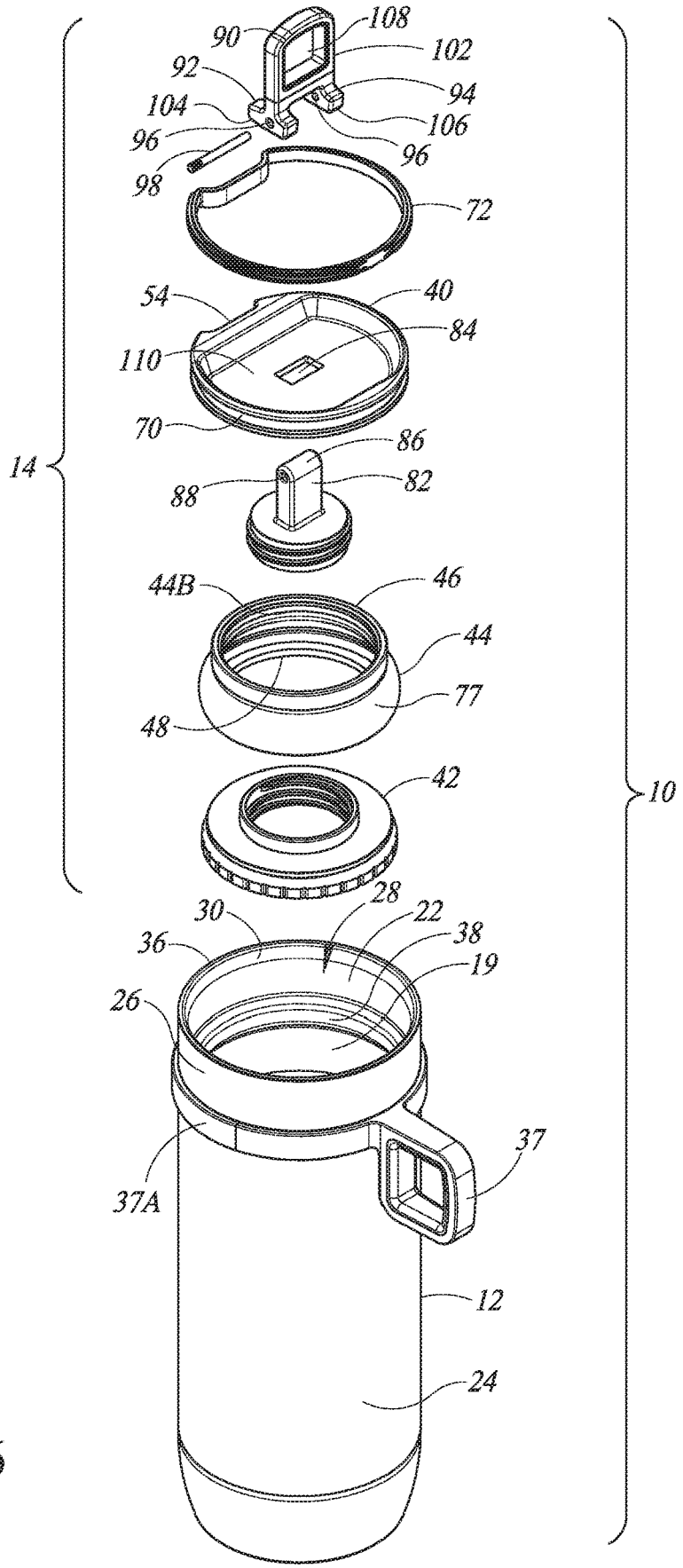
FIG. 6 is a top perspective exploded view of the drink container of FIG. 1.
Figure 7:
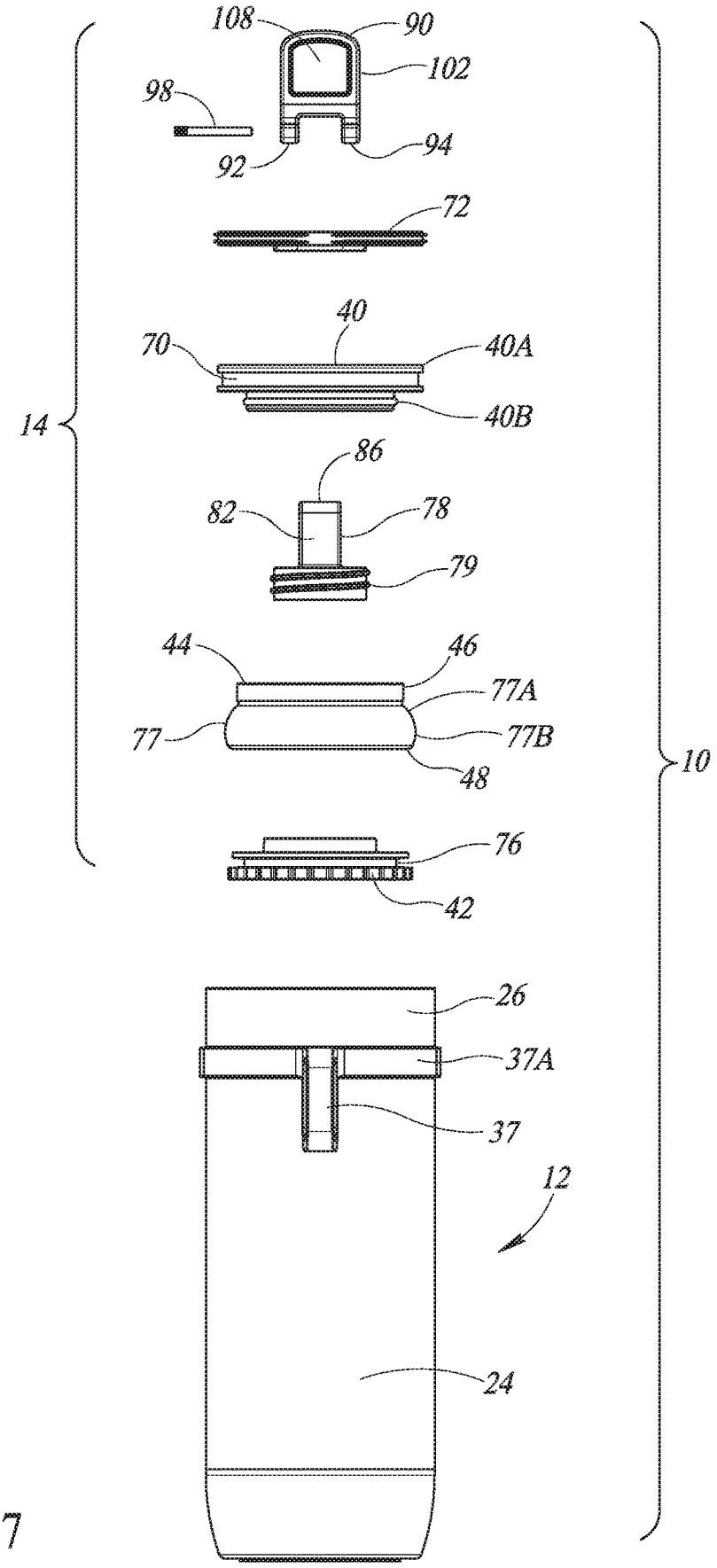
FIG. 7 is a rear elevational exploded view of the drink container of FIG. 1.
Figure 8:
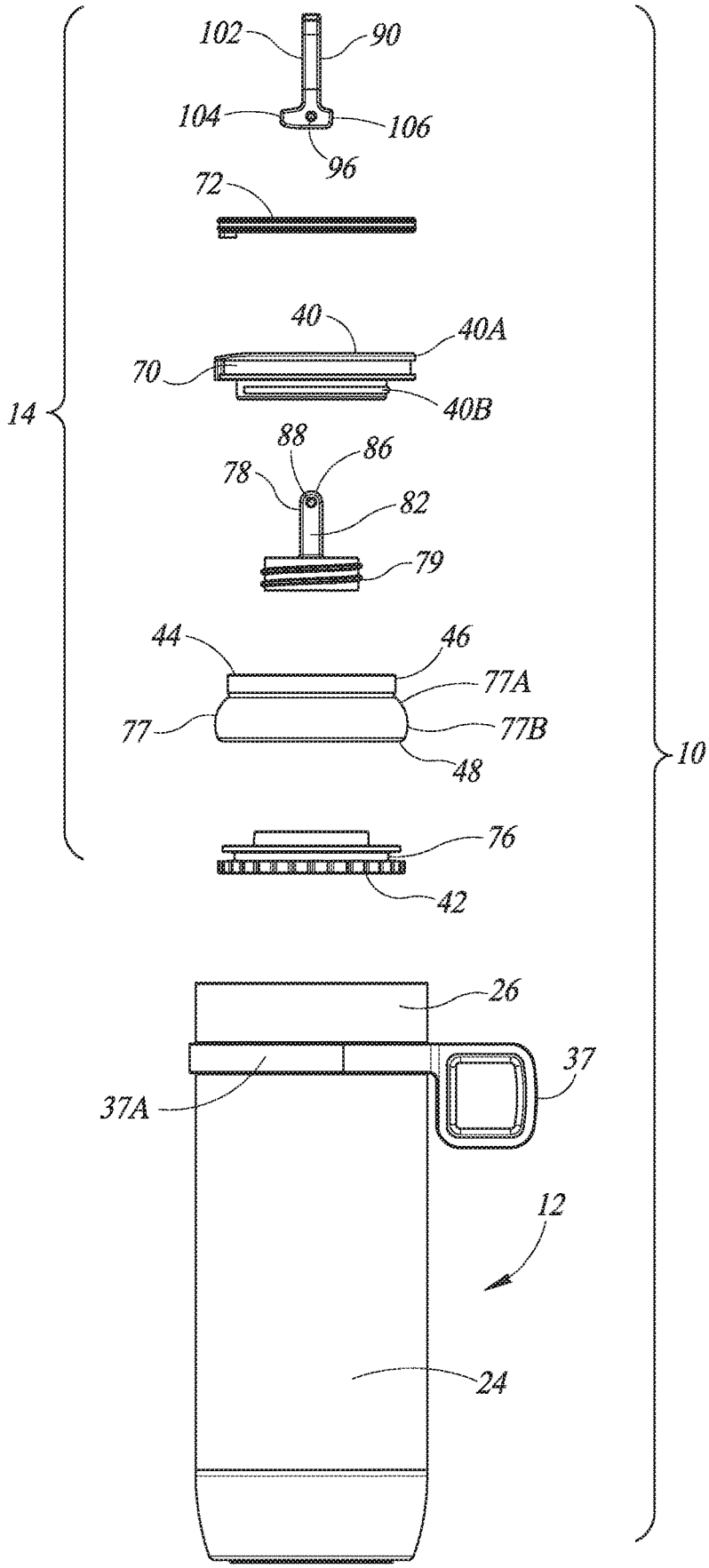
FIG. 8 is a left side elevational exploded view of the drinking container of FIG. 1.
Figure 9:
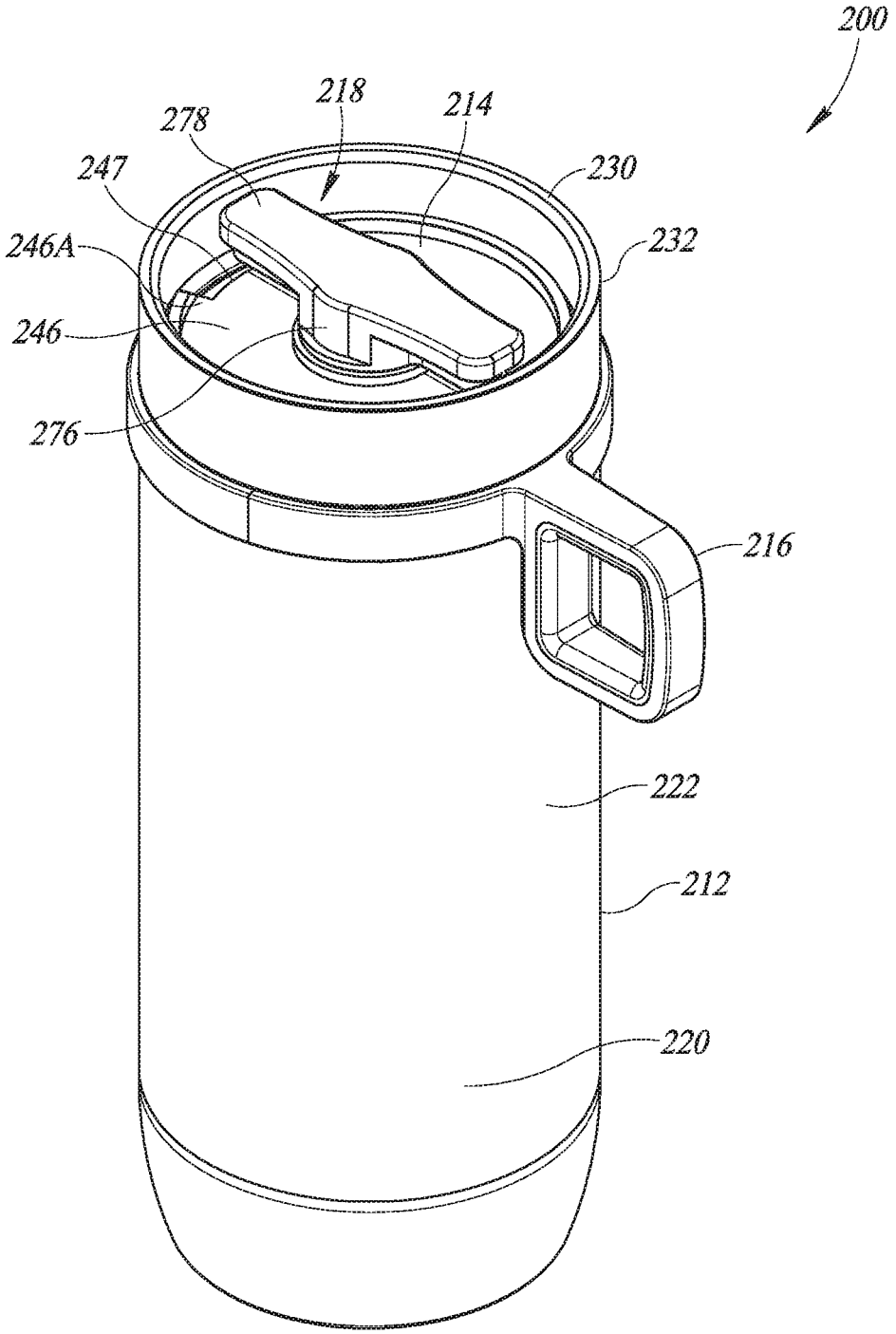
FIG. 9 is a top perspective view of a drink container with a second embodiment of the plug lid in a closed operational position.
Figure 10:
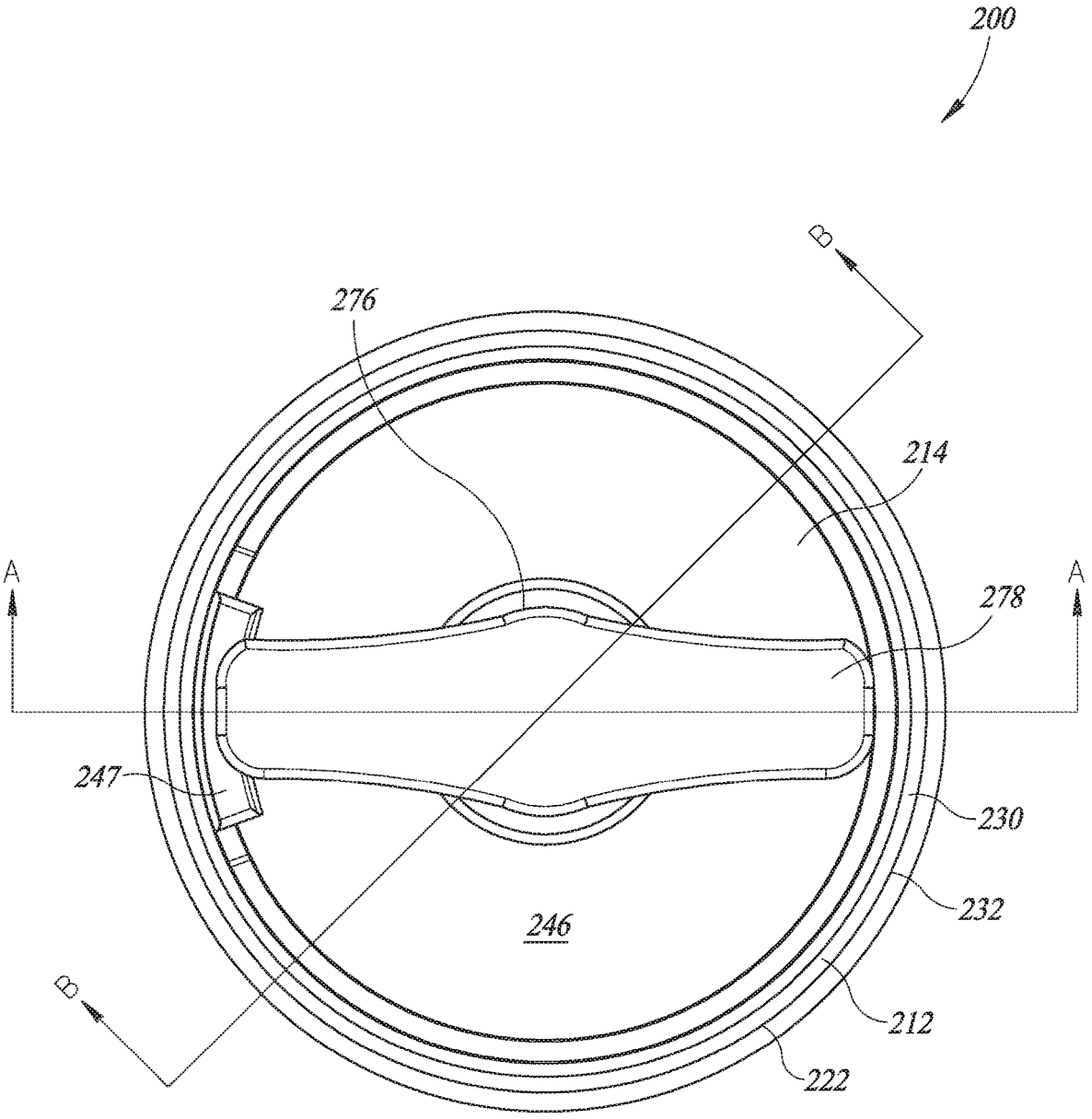
FIG. 10 is a top plan view of the drink container of FIG. 9 with the plug lid in the closed operational position.

When the handle portion 102 is in the third operational position, as best illustrated in FIGS. 3B and 3C, with the handle portion 102 extending straight upward, the first and second cams 104 and 106 extend laterally outward in opposite directions and transverse to the longitudinal axis 29 and are oriented generally parallel to an upper surface 110 of the upper seal carrier 40. In this position, the lower seal carrier 42 is at a maximum distance positioned below the upper seal carrier 40 such that the flexible tubular seal 44 is axially stretched out with the midportion 77 having a width which permits it to be easily moved past the body ridge 38 of the upper inner body portion 22 of the body 12, both when removing the lid 14 from the fluid passageway 28 and when inserting the lid 14 into the fluid passageway. In this position, the lid 14 is opened but not retained within the fluid passageway 28 so as to be removable by the user for filling the lower inner body portion 20 with a liquid or for washing the lid and/or the body 12.

Figure 1B:
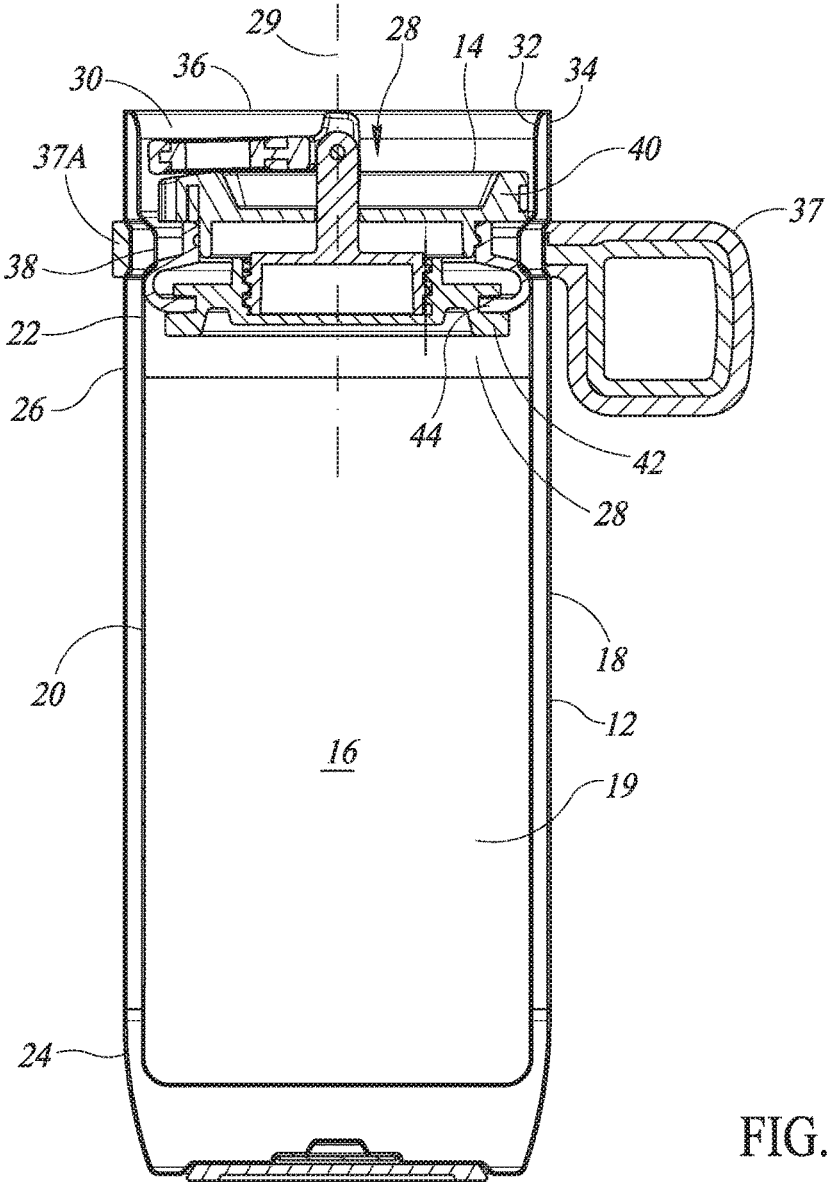
FIG. 1B is a cross-sectional view of the drink container of FIG. 1 taken substantially along the line 1B-1B of FIG. 1A.
Figure 1C:
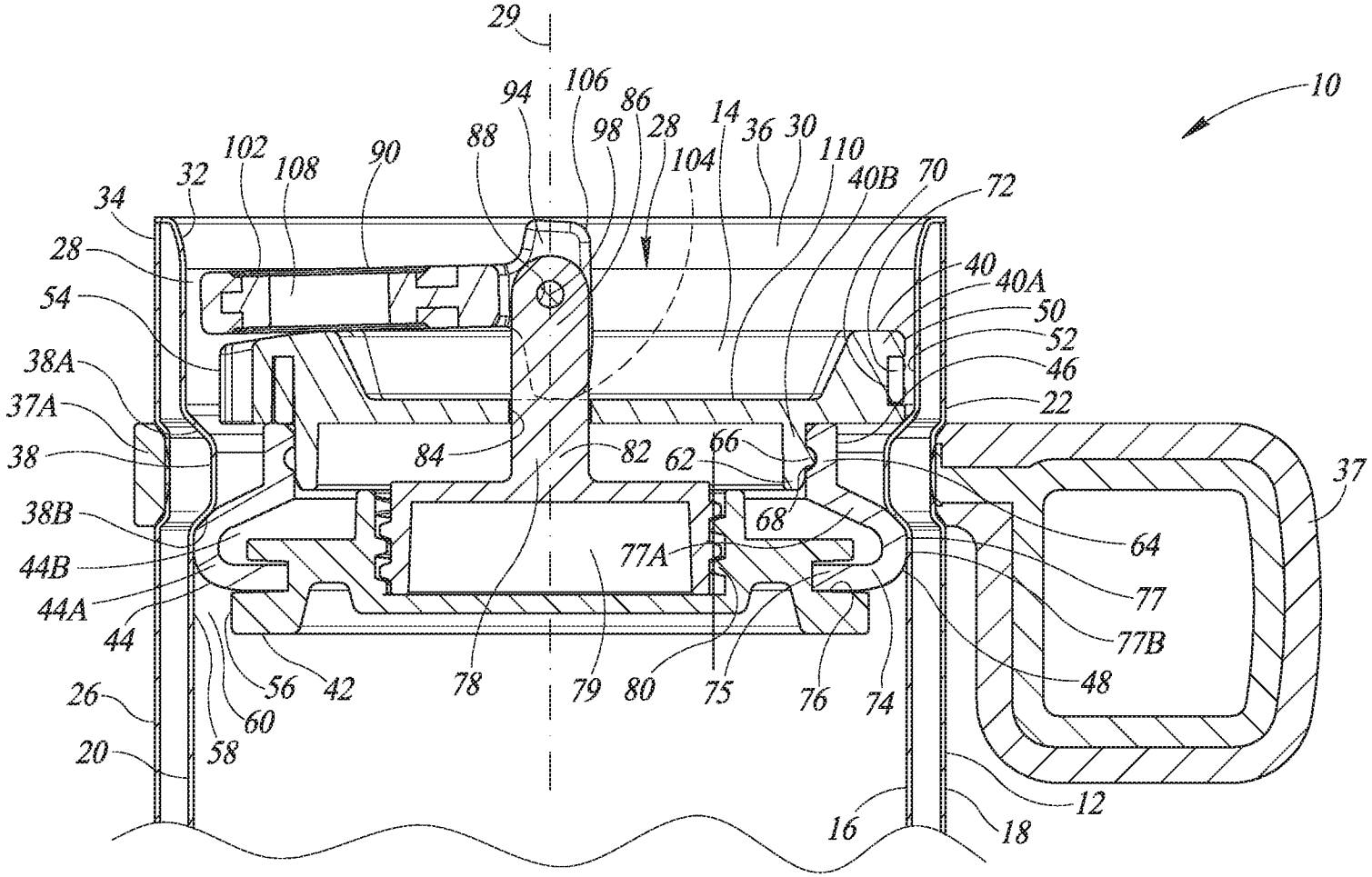
FIG. 1C is a partial enlargement of FIG. 1B.

When the handle portion 102 is rotated from the third operational position to the first operational position, with the handle portion 102 rotated to extend to the left (as viewed in FIG. 1B), as best illustrated in FIG. 1B the longer first cams 104 have been rotated counter-clockwise to engage the upper surface 110 of the upper seal carrier 40 (which rests atop the body ridge 38) and apply an upward axial force on the lifter member 82 which transmits that upward lifting force to the lower seal carrier 42 and moves the lower seal carrier closer to the upper seal carrier 40. During this movement the shorter second cams 106 are out of contact with the upper surface 110. This results in flexing of the tubular seal 44 radially outward (transverse to the longitudinal body axis 29), thus increasing the lateral width of the outward bulge of the midportion 77 of the tubular seal sufficiently and moving the midportion into fluid-tight sealingly engagement with a lower portion of the body ridge 38 of the upper inner body portion 22 of the body 12, creating a fluid-tight compression seal therewith. In this position, the lower seal carrier 42 is at a minimum distance positioned below the upper seal carrier 40 such that the flexible tubular seal 44 is compressed. As a result, the lid 14 is closed and securely retained within the fluid passageway 28 so no liquid can pass fully through the fluid passageway 28 and be drunk from the drink container 10, and the lid 14 cannot be removed from the body 12. If the handle portion 102 was moved to the first operational position with the lid 14 removed from the fluid passageway 28, the expanded midportion 77 of the tubular seal 44 would prevent it from being reinserted into the fluid passageway.

Figure 2:
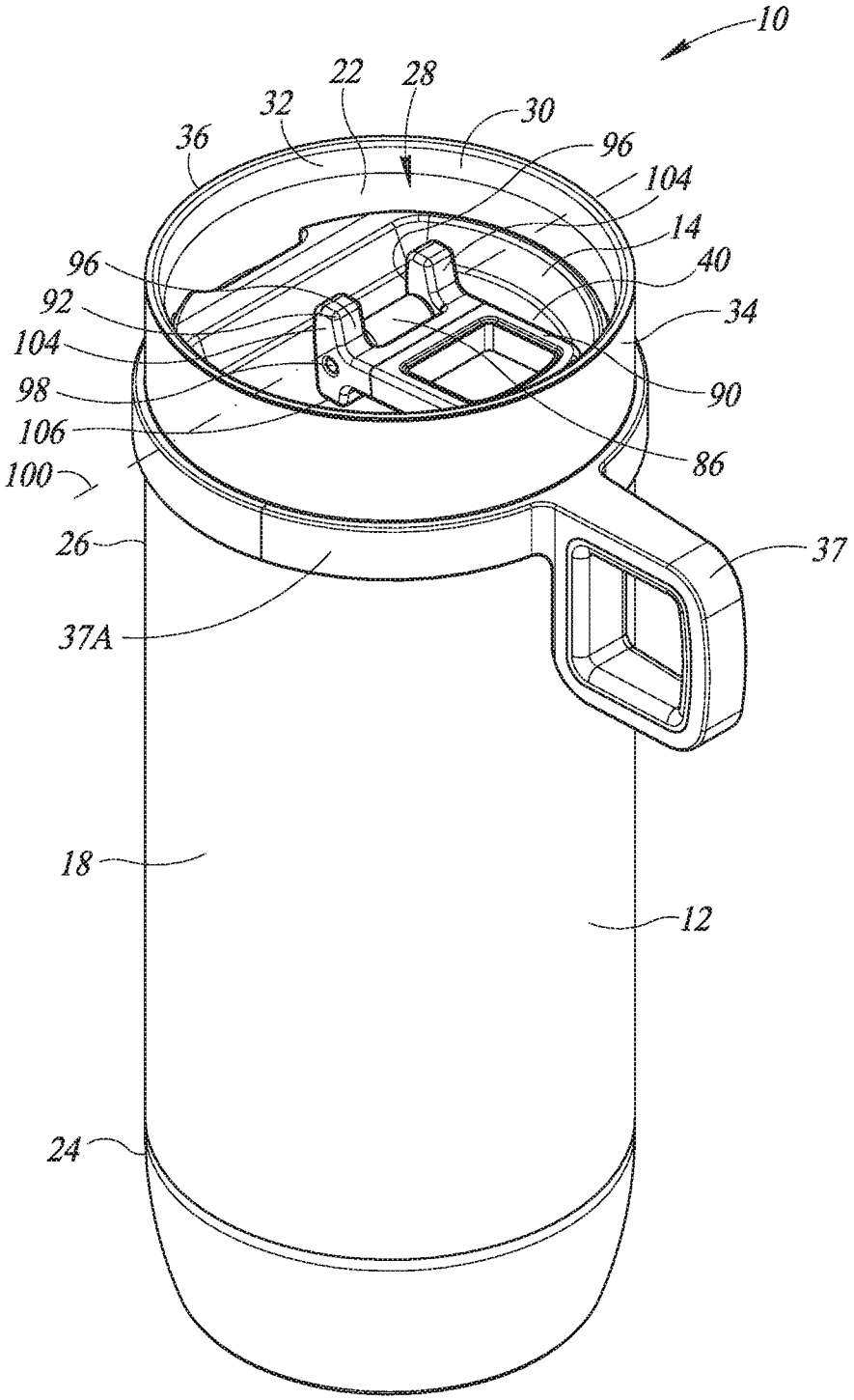
FIG. 2 is a top perspective view of the drink container of FIG. 1 with the plug lid in a second operational position.
Figure 2A:
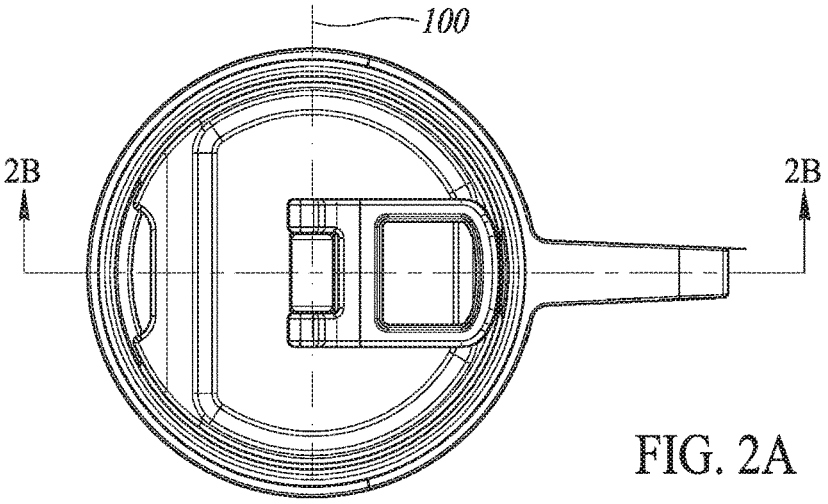
FIG. 2A is a top plan view of the drink container of FIG. 2.
Figure 2B:
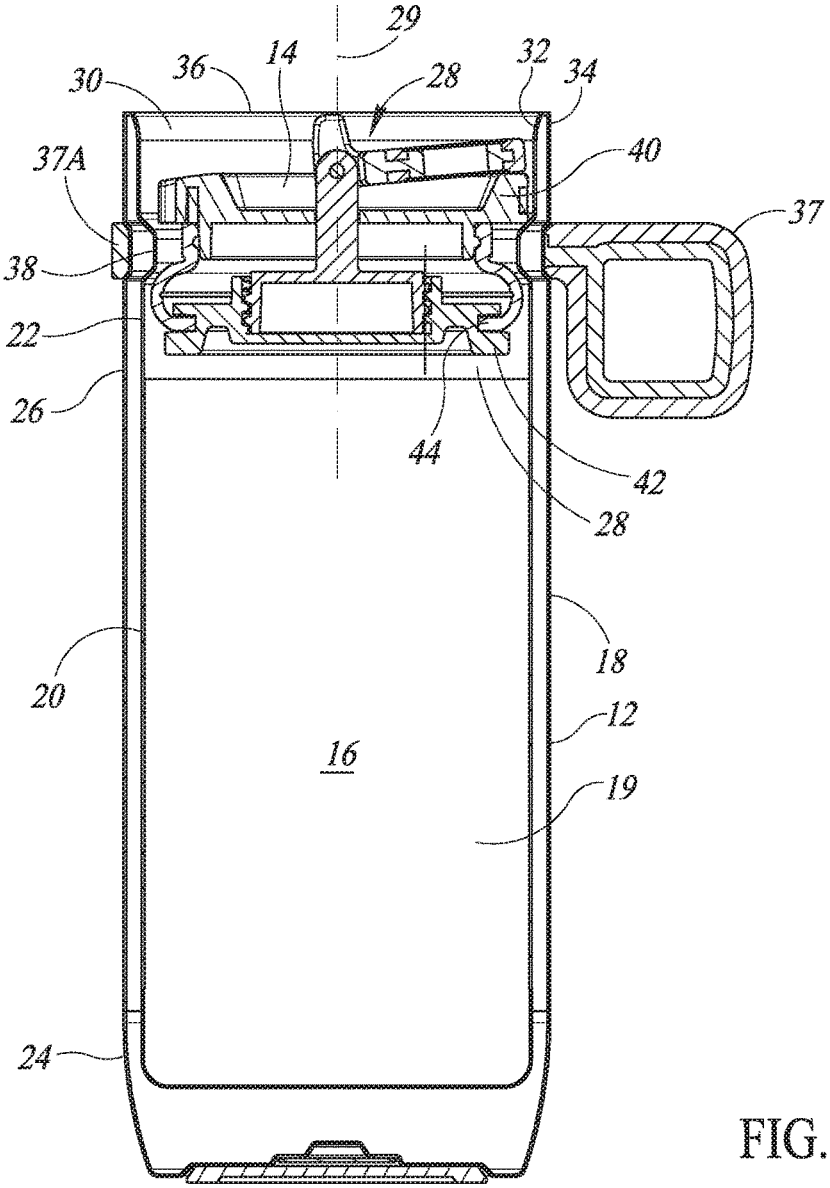
FIG. 2B is a cross-sectional view of the drink container of FIG. 2 taken substantially along the line 2B-2B of FIG. 2A.
Figure 2C:
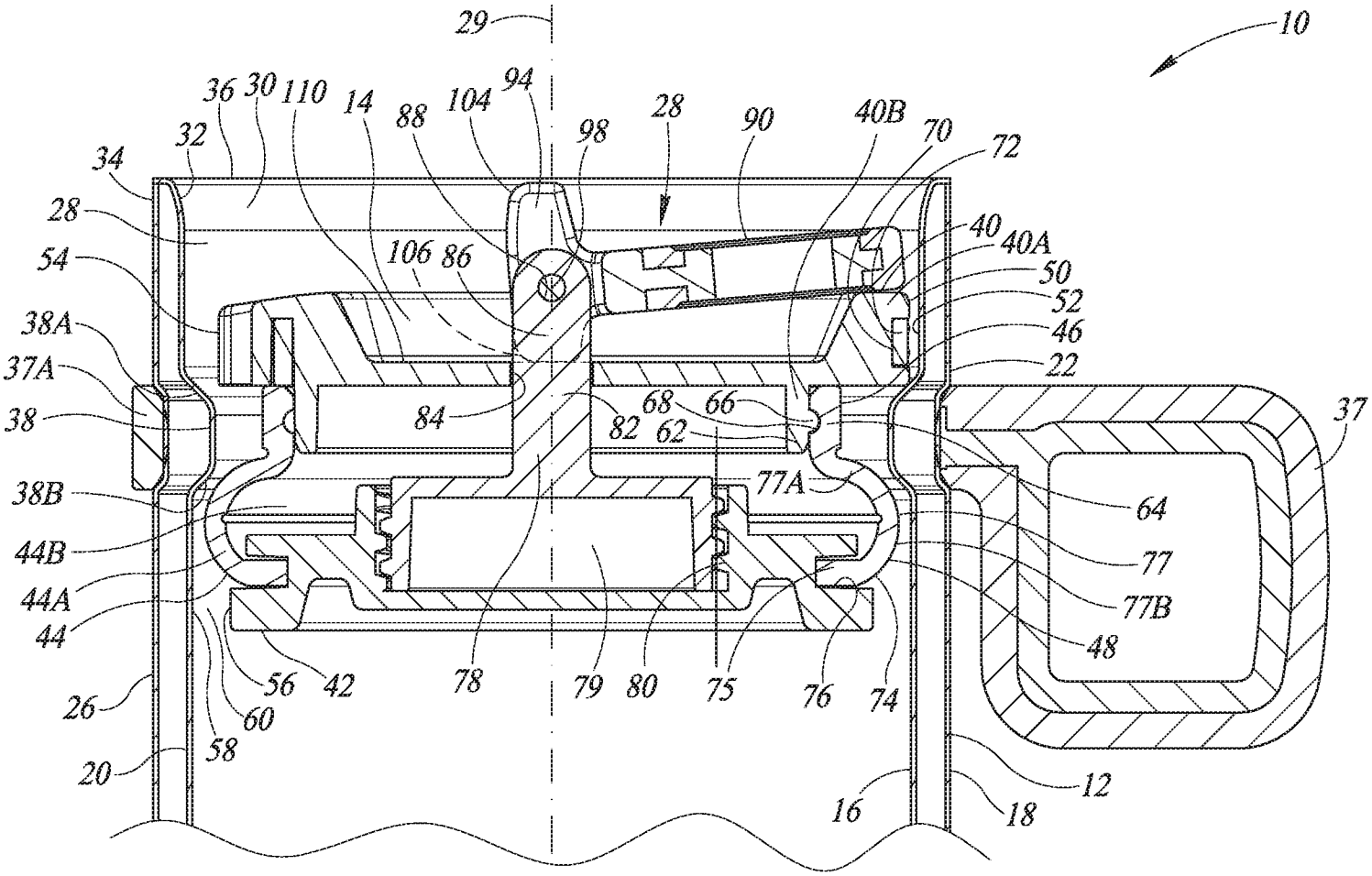
FIG. 2C is a partial enlargement of FIG. 2B.

When the handle portion 102 is rotated from third operational position to the second operational position, with the handle portion 102 rotated to extend to the right (as viewed in FIG. 2B), as best illustrated in FIG. 2B the shorter second cams 106 have been rotated clockwise to engage the upper surface 110 of the upper seal carrier 40 (which rests atop the body ridge 38) and apply an upward axial force on the lifter member 82 which transmits that upward lifting force to the lower seal carrier 42 and moves the lower seal carrier closer to the upper seal carrier 40. During this movement the longer first cams 104 are out of contact with the upper surface 110. This results in flexing of the tubular seal 44 radially outward (transverse to the longitudinal body axis 29), thus increasing the lateral width of the outward bulge of the midportion 77 of the tubular seal, but not sufficiently that it sealingly engages the lower portion of the body ridge 38 of the upper inner body portion 22 of the body 12 and thus does not close off the flow of liquid through the fluid passageway 28. In this position, the lower seal carrier 42 is at a middle distance positioned below the upper seal carrier 40, which is greater than the minimum distance resulting when the handle portion 102 is in the first operational position, but less than the maximum distance resulting when the handle portion is in the third operational position. As a result, the flexible tubular seal 44 is only partially compressed compared to when the handle portion 102 is in the first operational position. The partial compression of the tubular seal 44 causes the midportion 77 to move outward sufficiently that it will engage the lower portion of the body ridge 38 to inhibit removal of the lid 14 from within the fluid passageway 28 and prevent unintended removal should the lid experience an axial force moving tending to move it toward the upper end opening 30 of the upper inner body portion 22, while still permitting drinking liquid from the drink contain 10. For example, when the handle portion 102 is in the second operational position, if during drinking or carrying the drink container 10 it is sufficiently tilted or upwardly jarred such that an axial force is exerted on the lid 14 that would otherwise cause the lid to move out of the fluid passageway 28, before doing so the expanded midportion 77 of the tubular seal 44 will move into engagement with the lower portion of the body ridge 38 and thereby prevent the unintended lid removal. Depending on the extent of compression of the tubular seal 44 selected for the design, the user might still be able to apply enough intentional upward force on the handle portion 102 to flex the midportion 77 inward sufficiently to result in removal of the lid 14 from the fluid passageway 28.

The three position lid 14 allows the user to drink from the drinking container 10 while at the same time keeping the lid securely and safely retained within the fluid passageway 28 against unintended lid removal, and to both open the fluid passageway for drinking and close the fluid passageway for transport without having to remove the lid from or reinsert the lid into the fluid passageway. These operations and features are accomplished simply by rotating the handle portion between its three operational positions without removal and reinsertion of the lid 14.

An alternative embodiment of a drinking vessel or drink container 200 in accordance with the present embodiment is shown in FIGS. 9-25. The drink container is shown in a closed state in FIGS. 9-12. The drink container 200 includes a substantially cylindrical body 212 and a lid 214. As discussed above for the body 12, the body 212 may have a double wall construction for improved thermal insulation, using an inner body positioned and secured within an outer body. In this illustrated alternative embodiment, the body 212 has a single wall construction, which in a double wall construction drink container would serve as the inner body.

Figure 11:
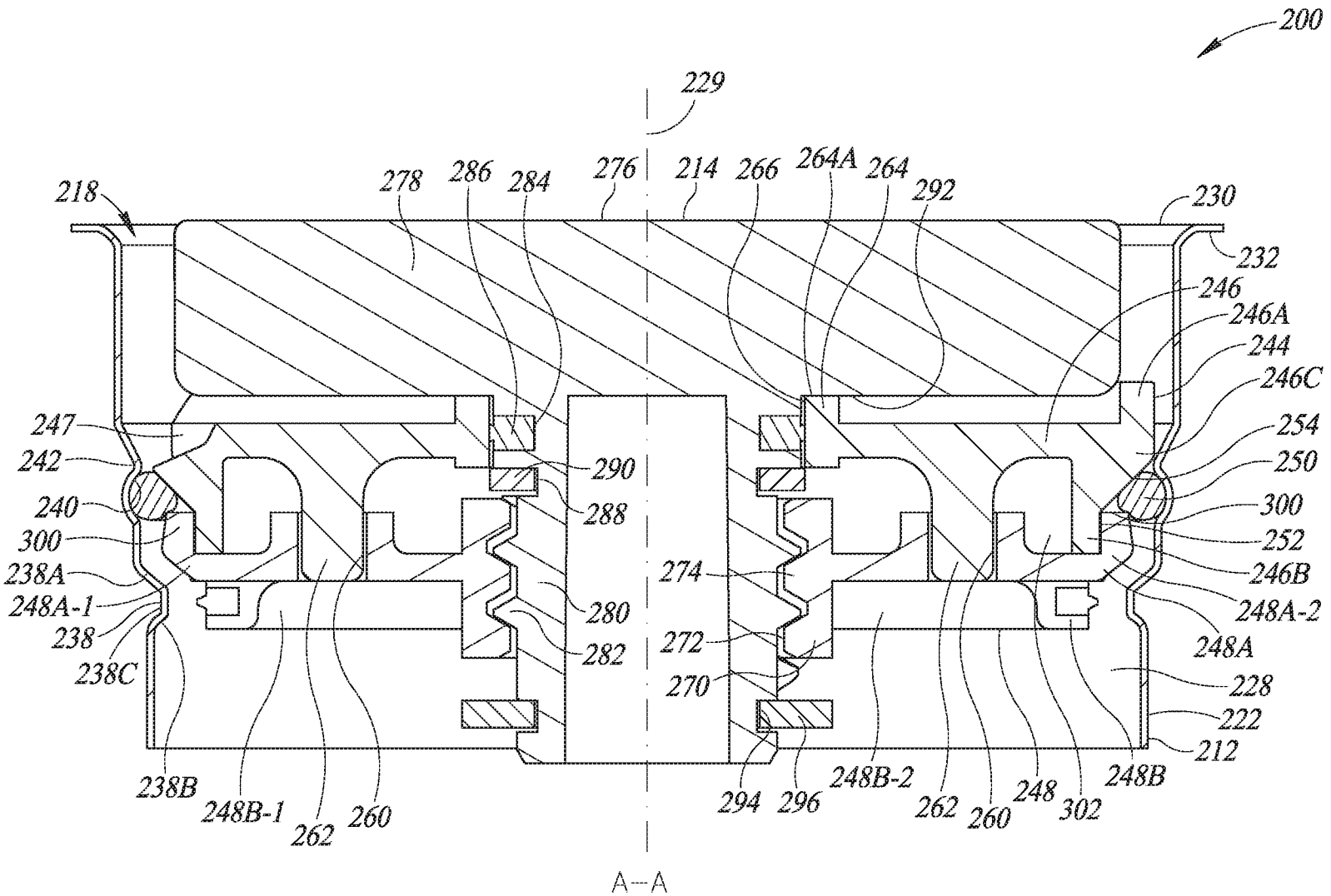
FIG. 11 is a cross-sectional view of the drink container of FIG. 9 with the plug lid in the closed operational position taken substantially along the line A-A of FIG. 10.
Figure 12:
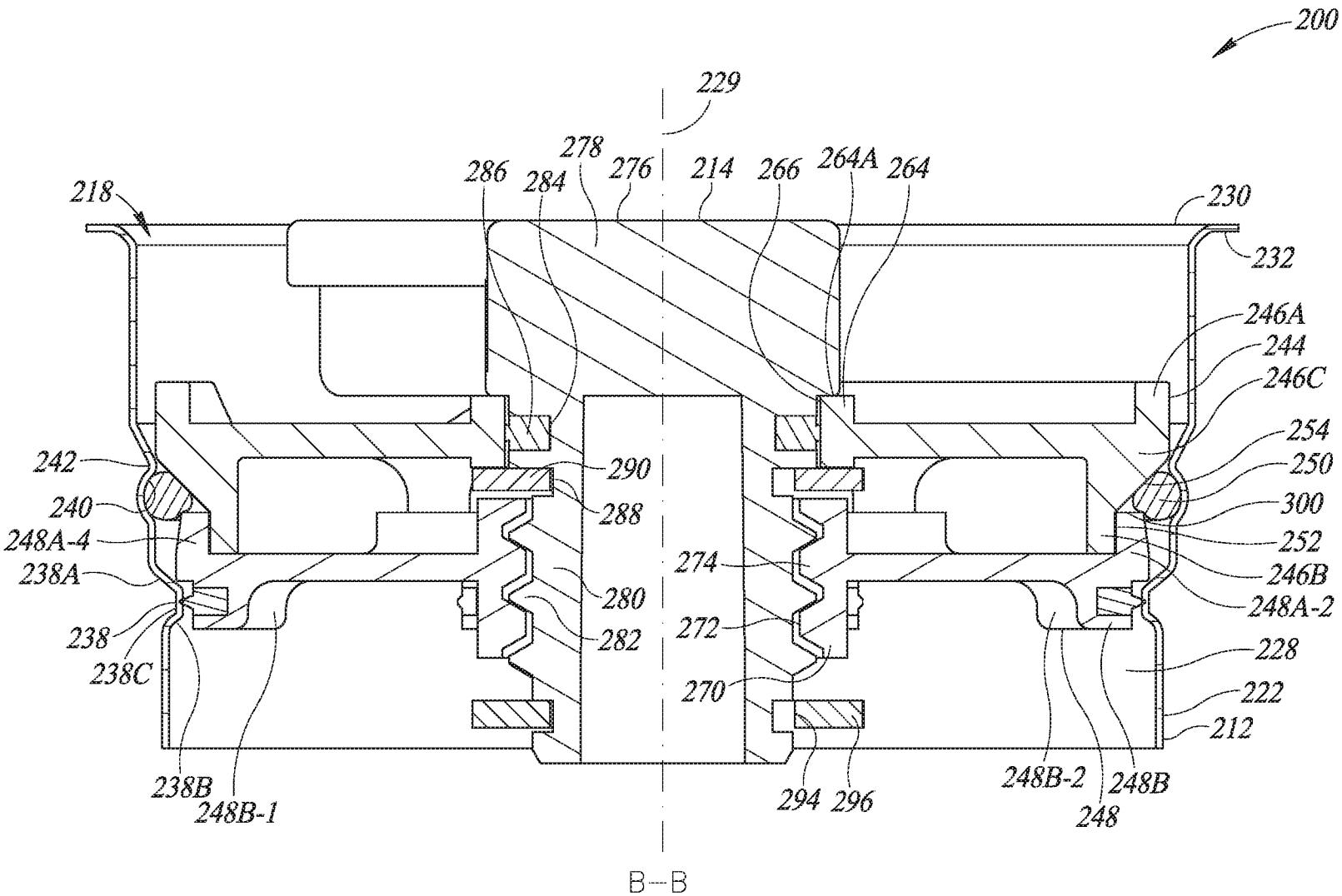
FIG. 12 is a cross-sectional view of the drink container of FIG. 9 with the plug lid in the closed operational position taken substantially along the line B-B of FIG. 10.
Figure 13:
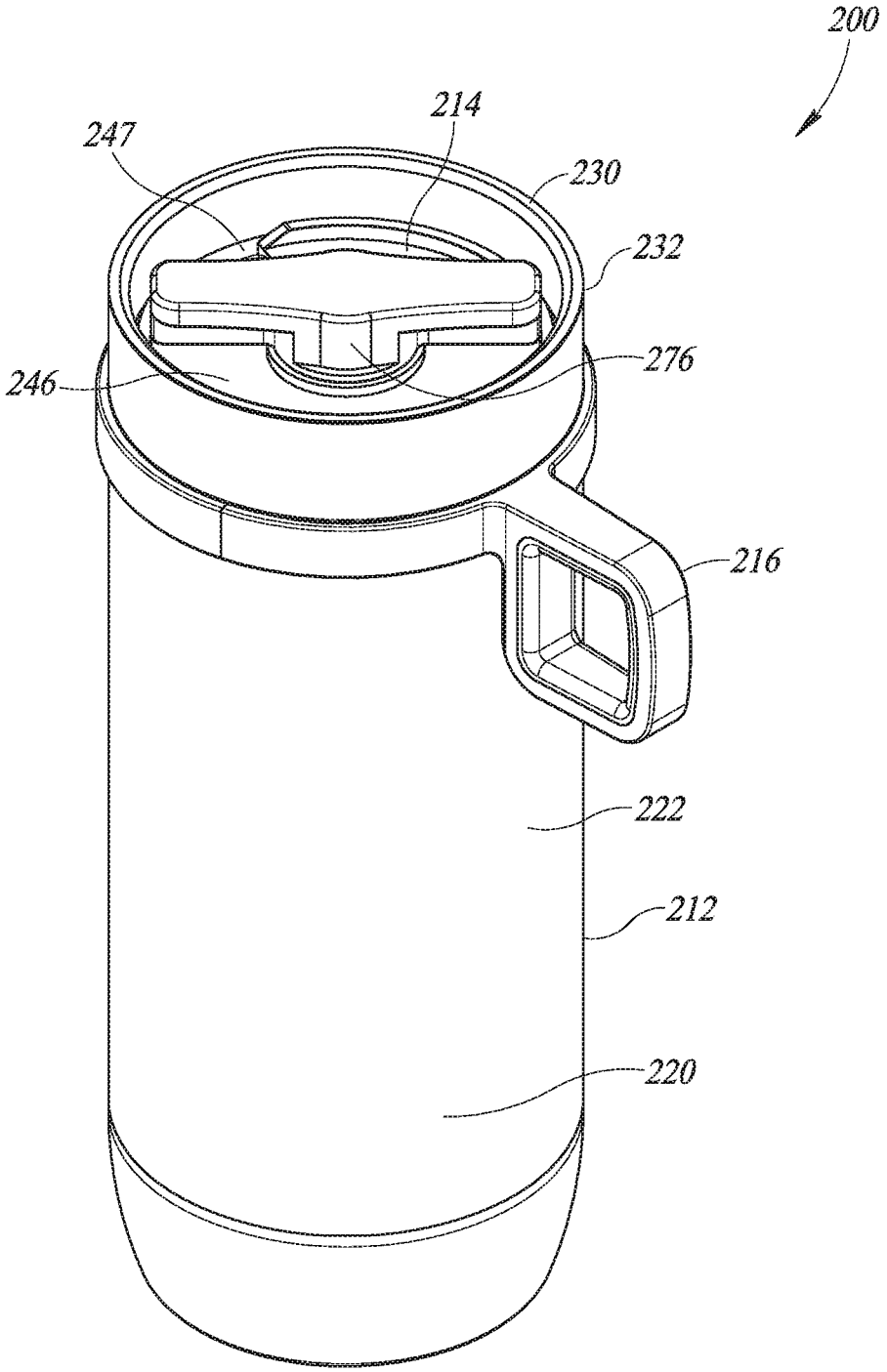
FIG. 13 is a top perspective view of the drink container of FIG. 9 with the plug lid in an intermediate operational position.
Figure 14:
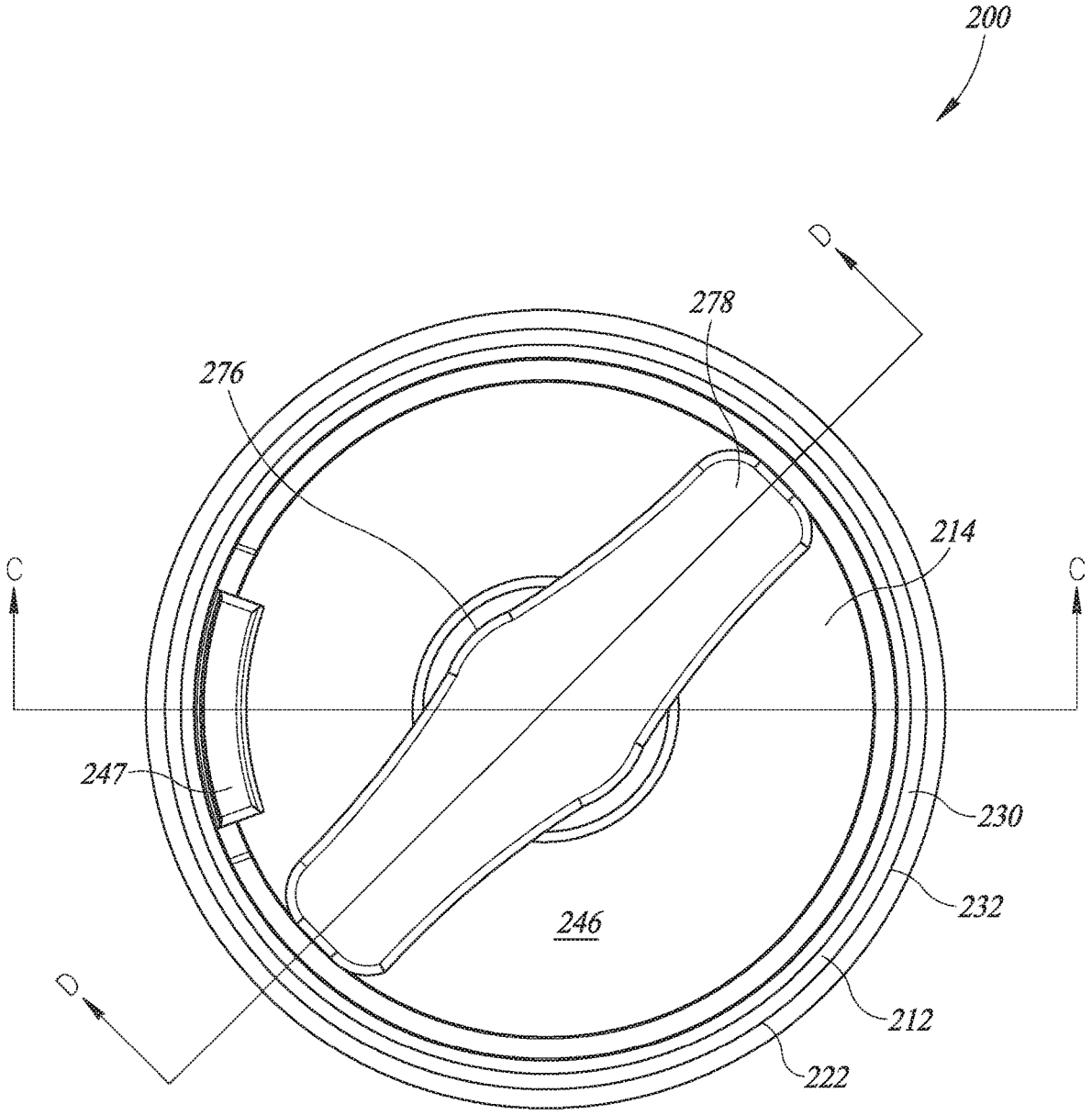
FIG. 14 is a top plan view of the drink container of FIG. 9 with the plug lid in the intermediate operational position.
Figure 15:
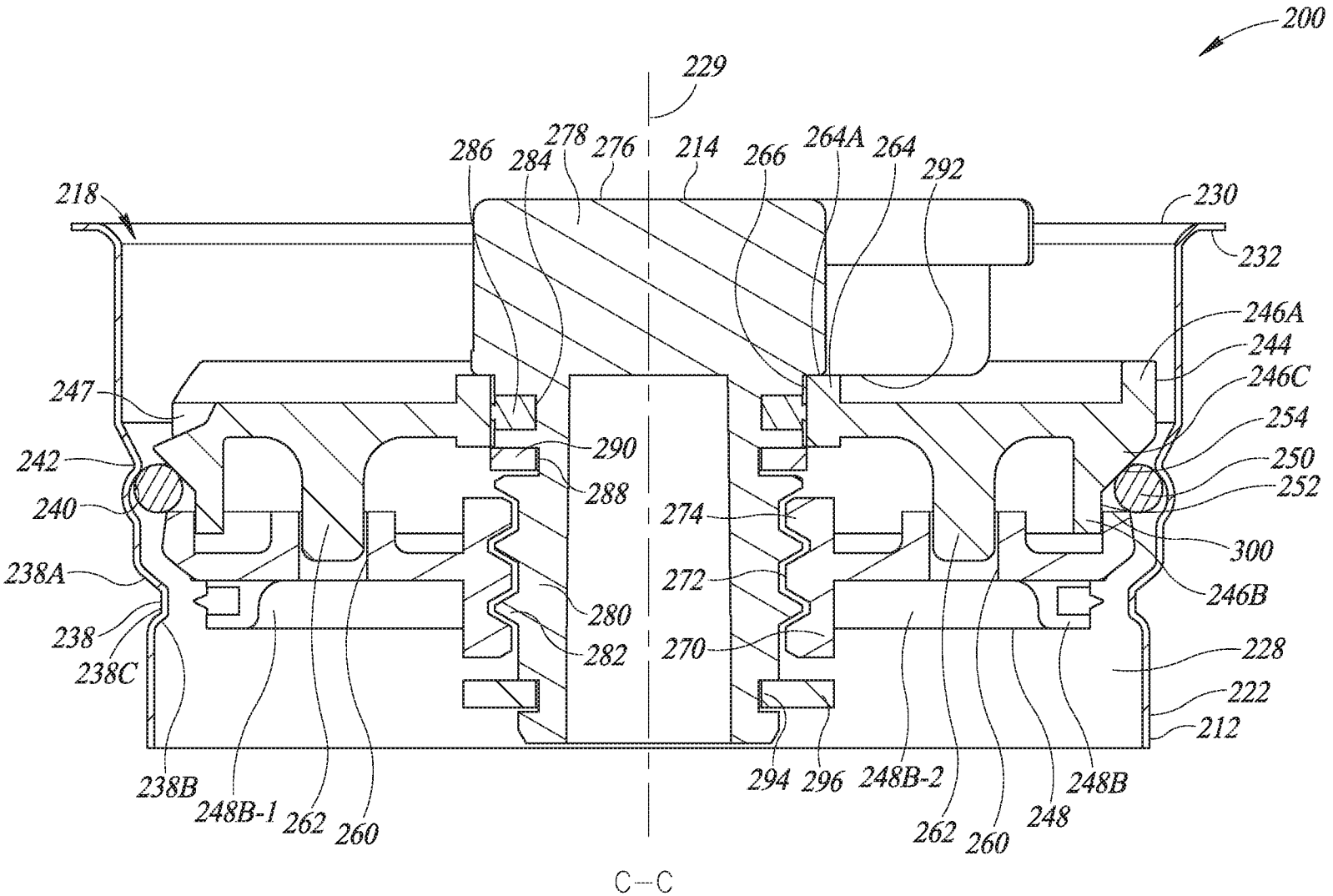
FIG. 15 is a cross-sectional view of the drink container of FIG. 9 with the plug lid in the intermediate operational position taken substantially along the line C-C of FIG. 10.

The body 212 has a lower body portion 220 and an upper body portion 222 defining a hollow interior chamber 218. A drinkable liquid (not shown) may be stored in the lower body portion 220 when the drink container 200 is in an upright position. As illustrated in FIGS. 11 and 12, the upper body portion 222 has an interior fluid passageway 228 with a longitudinal axis 229 and an upper end opening 230 at the upper end of the upper body portion 222 through which the liquid stored in lower body portion 220 may flow for drinking or pouring when the drink container 200 is sufficiently tilted. An upper end portion 232 of the upper body portion 222 defines a drinking lip at the upper end of the body 212 on which the lips of a user may be positioned for drinking the liquid stored in lower body portion 220 when the drink container 200 is sufficiently tilted. The body 212 may include a handle 216 to facilitate the user holding the drink container 200.

The upper body portion 222 has an interior, circumferentially extending inward protrusion or body ridge 238 projecting inward within the fluid passageway 228. The body ridge 238 extends continuously about the circumference of the upper body portion 222. The body ridge 238 has a circumferentially extending upper wall portion 238A which slopes downward in the inward direction, a circumferentially extending lower wall portion 238B which slopes upward in the inward direction, and a circumferentially extending vertical middle wall portion 238C positioned between the upper and lower wall portions. As will be described, the body ridge 238 serves as a stop to support the lid 214 when within the fluid passageway 228 and limit downward movement of the lid within the fluid passageway, and also as an engagement surface the lid grips when within the fluid passageway to inhibit its unintentional upward movement within the fluid passageway. In alternative embodiments not illustrated, the body ridge 238 may not be continuous.

The upper body portion 222 further has an interior, inwardly opening, circumferentially extending upper body recess 240 within the fluid passageway 228, at a location above the body ridge 238 and below the upper end opening 230, which extends continuously about the internal circumference of the upper body portion and serves as a seal seat, as will be described in greater detail below. An upper edge wall 242 of the recess 240 protrudes inwardly into the fluid passageway 228.

The lid 214 is a plug-type closure which is insertable by the user into the fluid passageway 228 through the upper end opening 230 for use of the drink container 200 for storing, transporting and drinking a liquid, and is removable therefrom when desired by the user for washing the lid and/or body 212 of the drink container. The lid 214 may be operated to move between two states, i.e., a closed and securely retained first state as shown in FIGS. 9-12, and an opened and retained, but easily removable second state as shown in FIGS. 17-20. FIGS. 13-16 show the lid 214 in an intermediate position through which the lid moves when transitioning between the first (closed) state and the second (opened) state, as will be described in more detail below.

In the first (closed) state the lid 214 is closed and securely retained within the fluid passageway 228 so no liquid can be drunk or spilled from the drink container 200 and the lid cannot be removed from the body 212 (or inserted into the fluid passageway). In the second (opened) state the lid 214 is opened for drinking and retained within the fluid passageway 228 against unintended removal, but with sufficient upward force applied by the user, the lid is removable for filling the lower body portion 220 with a liquid or for washing the lid and/or the body 212. The individual component parts of the drink container 200 are separately illustrated in the exploded views of FIGS. 21-23 and the component views of FIGS. 24 and 25.

The lid 214 includes a seal assembly 244 having an upper member 246, a lower member 248 and a stretchable and resilient ring seal 250. In the illustrated embodiment the ring seal 250 is an O-ring but other shapes of ring-type seals may be used. The upper member 246 has a circumferentially extending, perimeter upper member portion 246A, a smaller diameter circumferentially extending, perimeter lower member portion 246B and a circumferentially extending, perimeter middle member portion 246C positioned between the upper and lower member portions. A drink dispensing aperture 247 formed by an inwardly recessed region of the perimeter upper member portion 246A is provided for liquid to pass for drinking when the drink container 200 is sufficiently tilted and the lid is in its second (opened) state. The perimeter lower member portion 246B has a circumferentially extending vertical, outward facing perimeter wall 252, and the perimeter middle member portion 246C has a circumferentially extending, outward facing perimeter smooth ramp wall 254 which slopes upward in the outward direction with the shape of a conical wall section.

Figure 19:
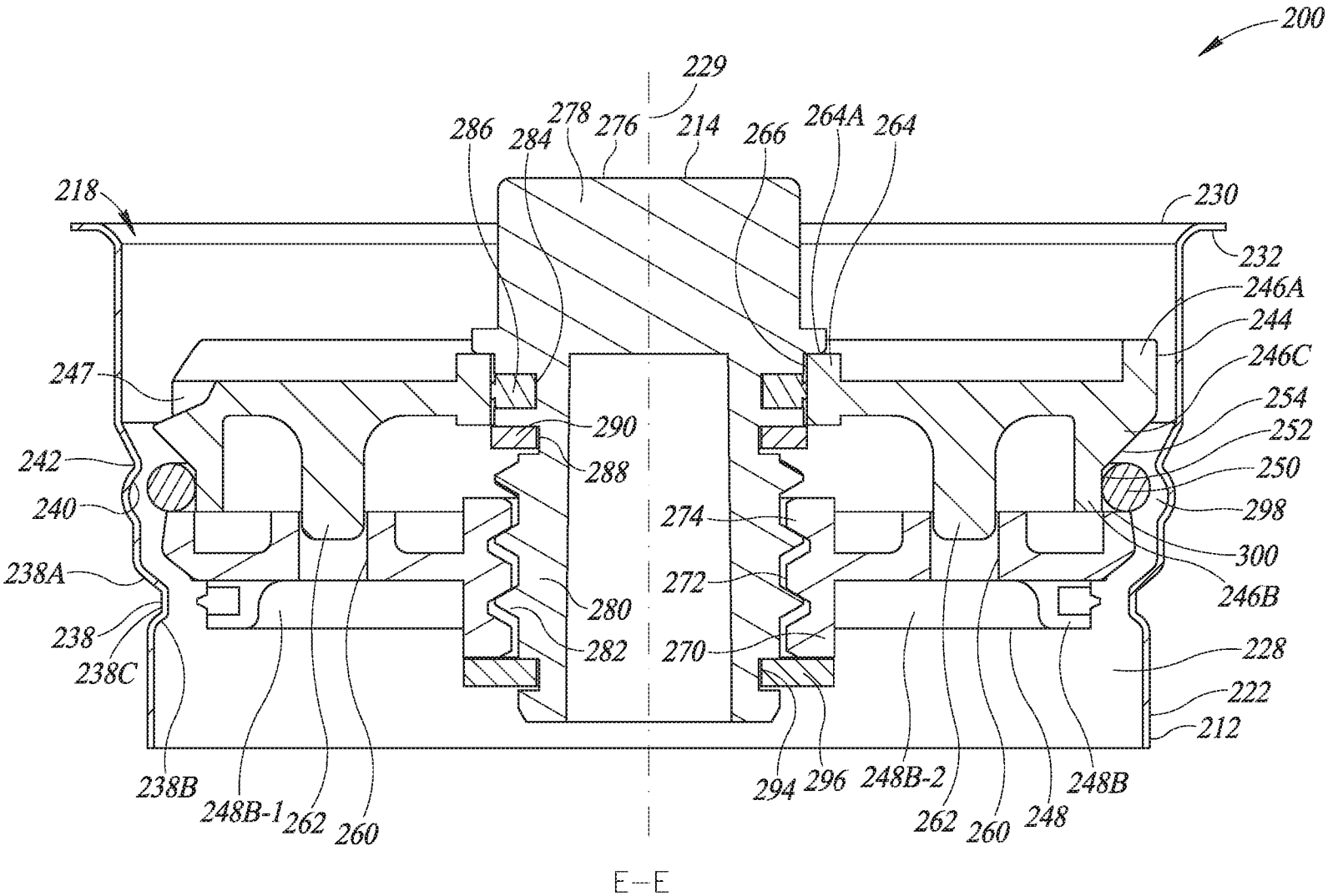
FIG. 19 is a cross-sectional view of the drink container of FIG. 9 with the plug lid in the closed operational position taken substantially along the line E-E of FIG. 10.
Figure 20:
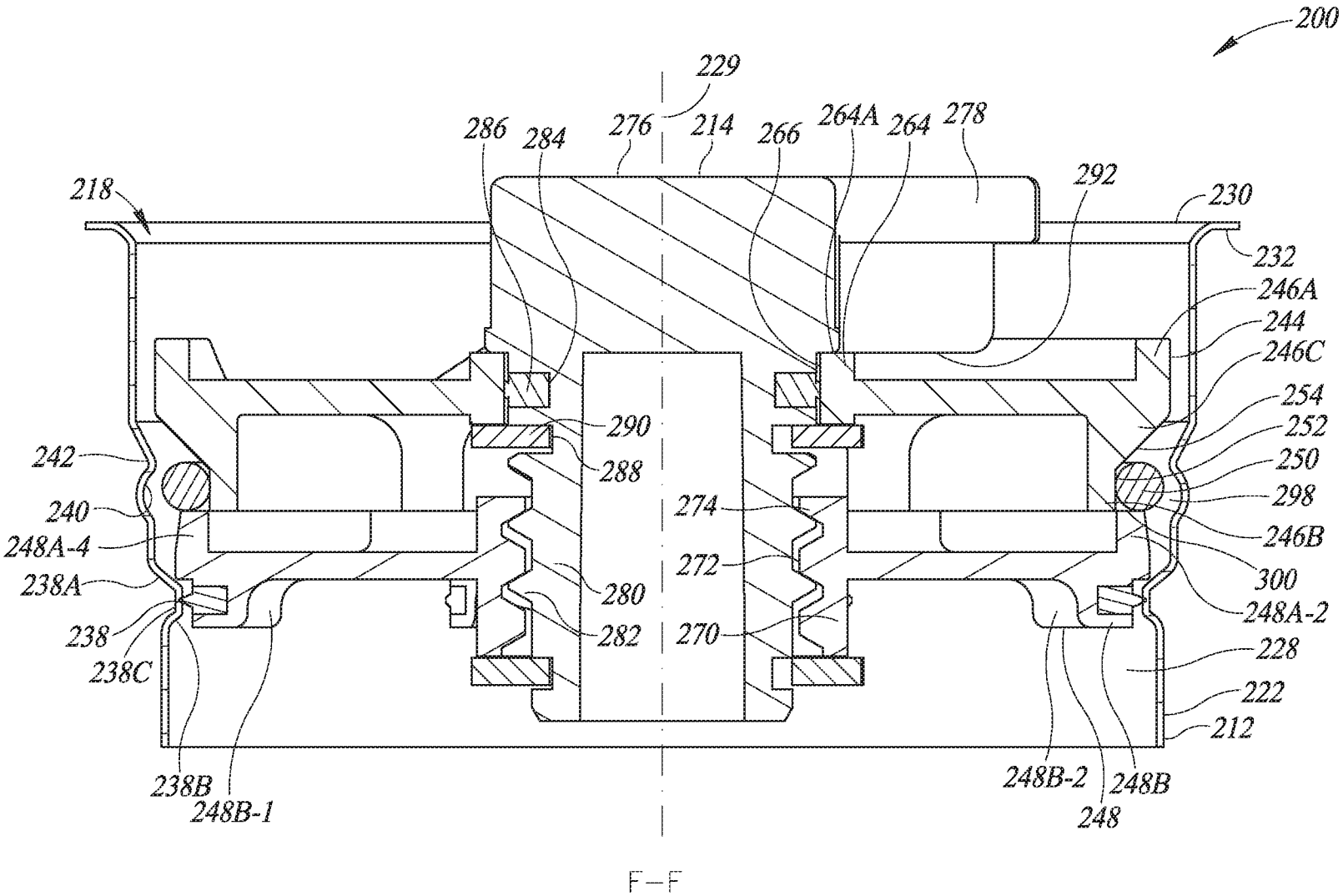
FIG. 20 is a cross-sectional view of the drink container of FIG. 9 with the plug lid in the closed operational position taken substantially along the line F-F of FIG. 10.
Figure 21:
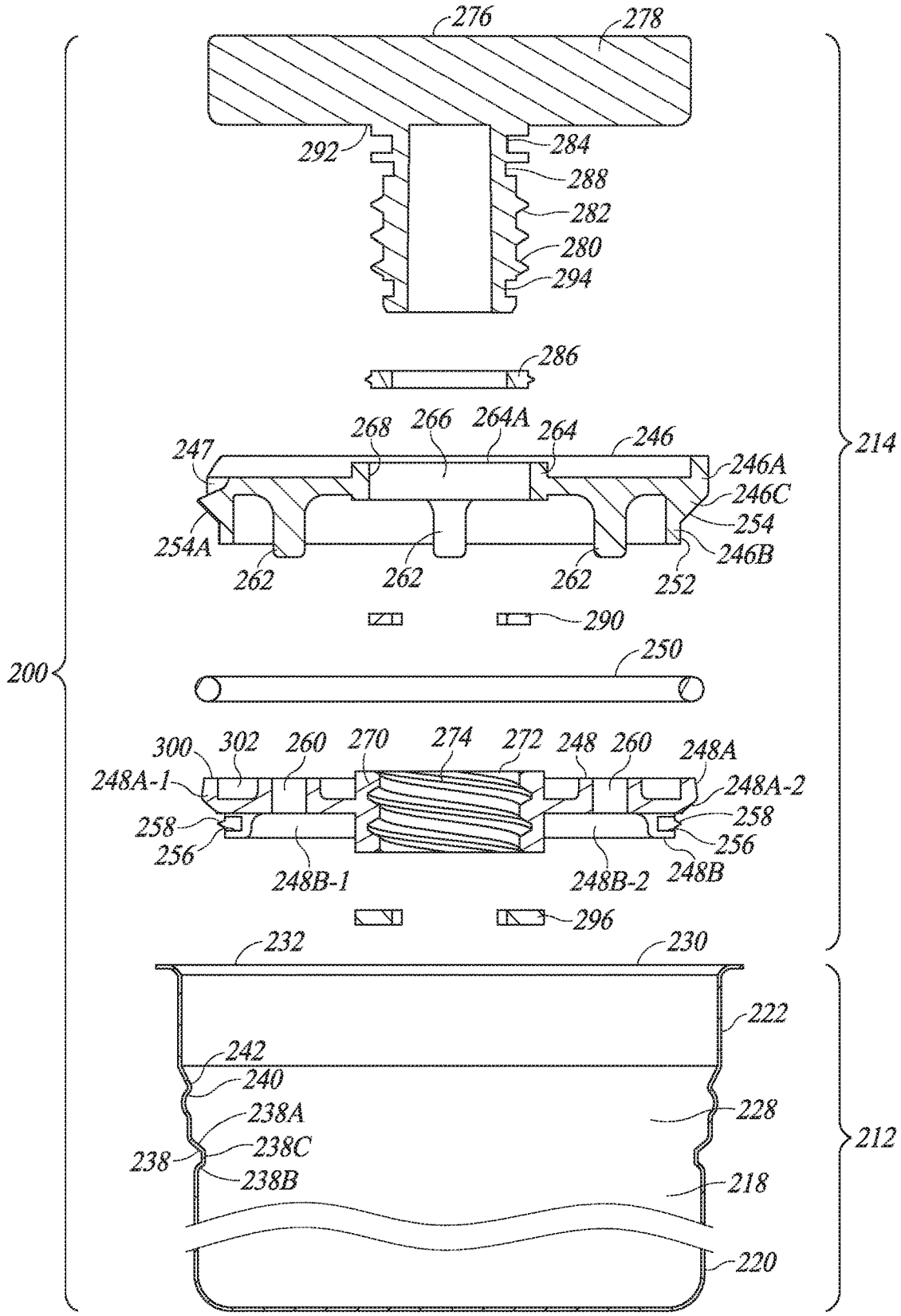
FIG. 21 is a partial cross-sectional, elevational exploded view of the drinking container of FIG. 9 taken substantially along the line A-A of FIG. 10.
Figure 22:
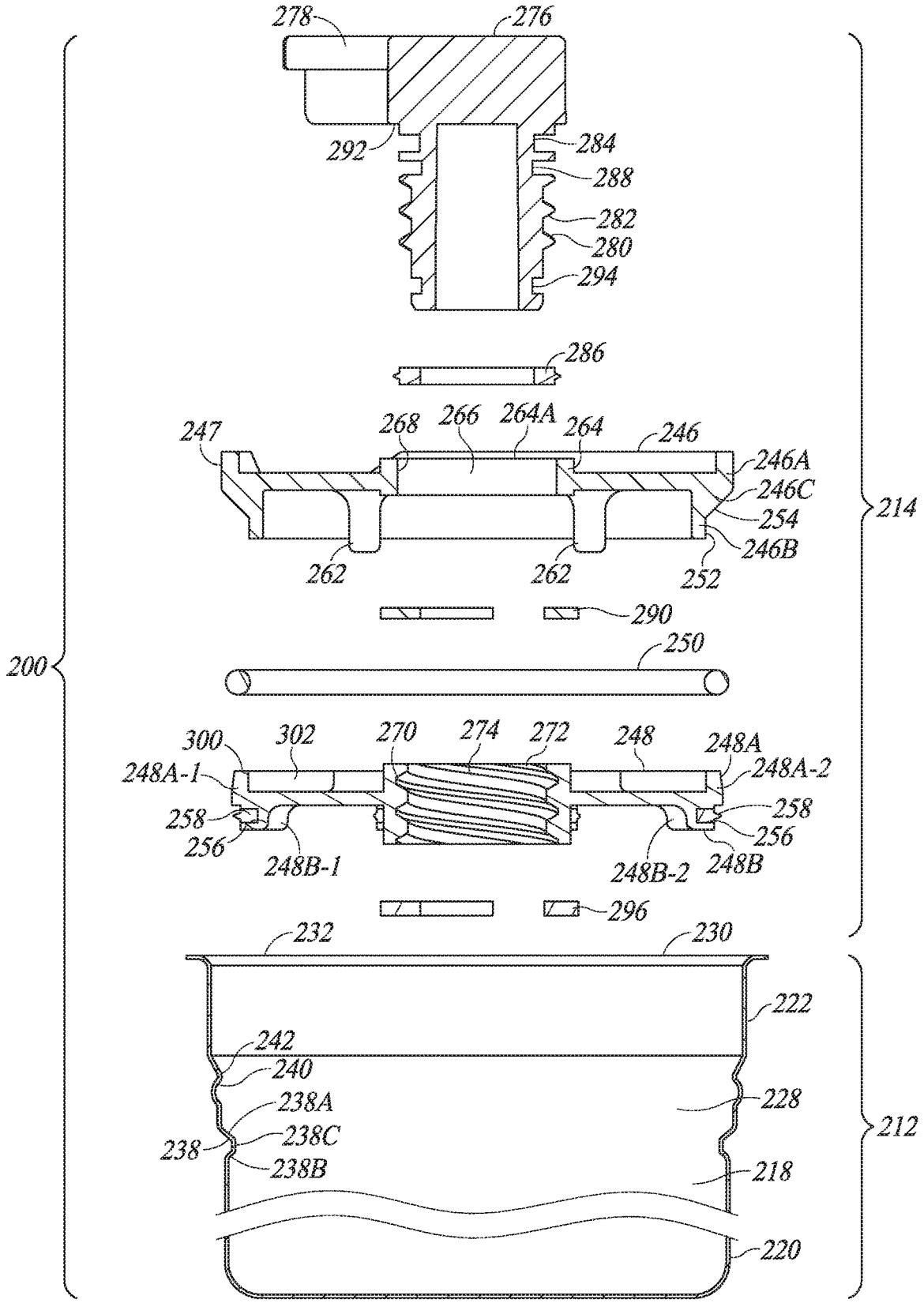
FIG. 22 is a partial cross-sectional, elevational exploded view of the drinking container of FIG. 9 taken substantially along the line B-B of FIG. 10.
Figure 23:
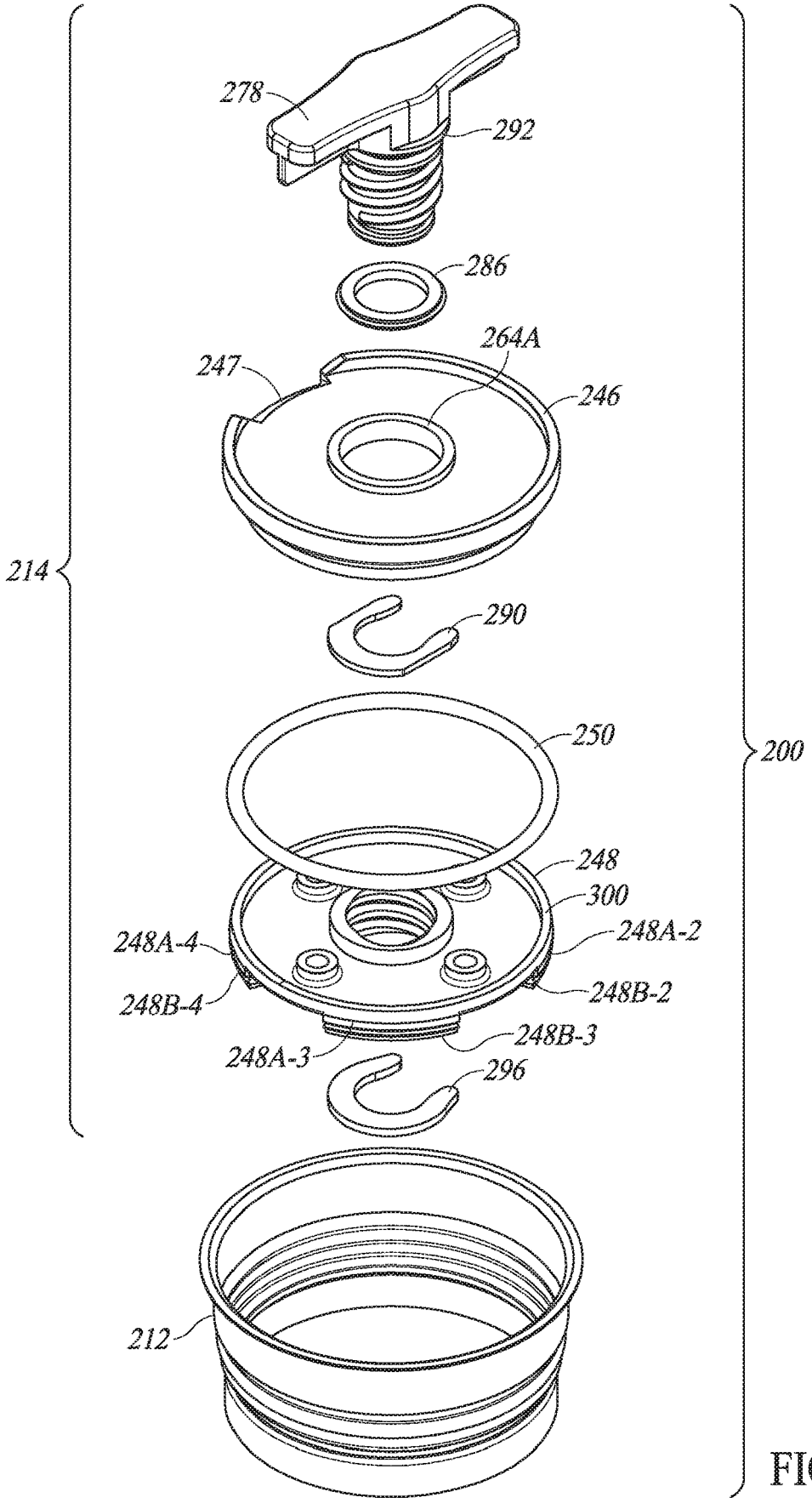
FIG. 23 is a top perspective exploded view of the drink container of FIG. 9.
Figure 24:
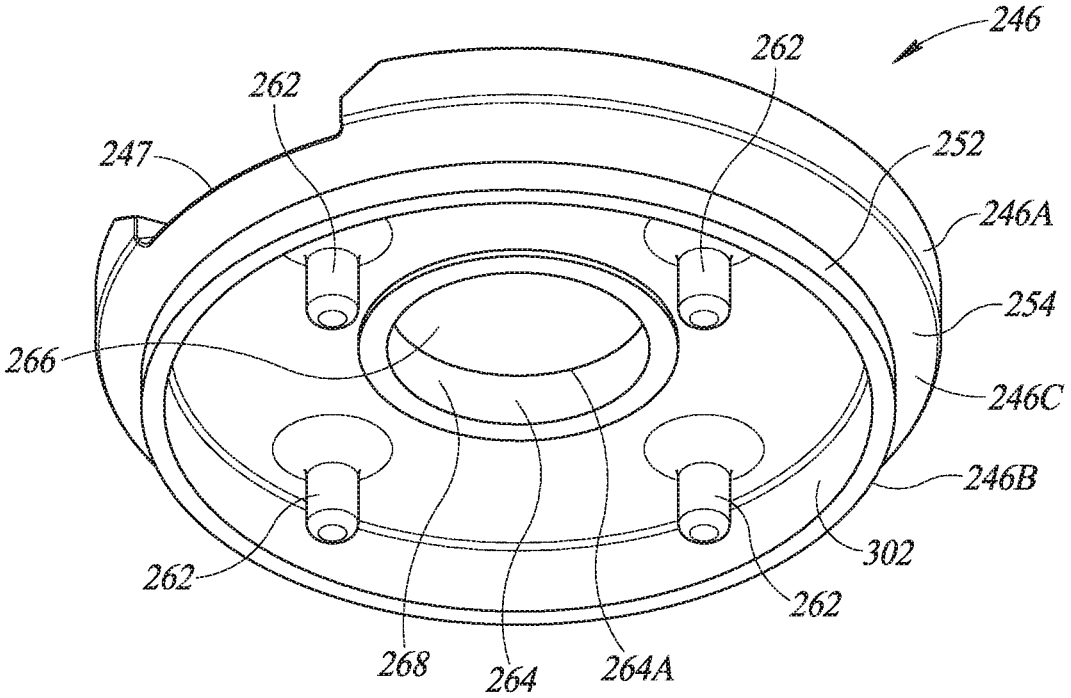
FIG. 24 is a bottom perspective exploded view of an upper member of a seal assembly of the drink container of FIG. 9.
Figure 25:
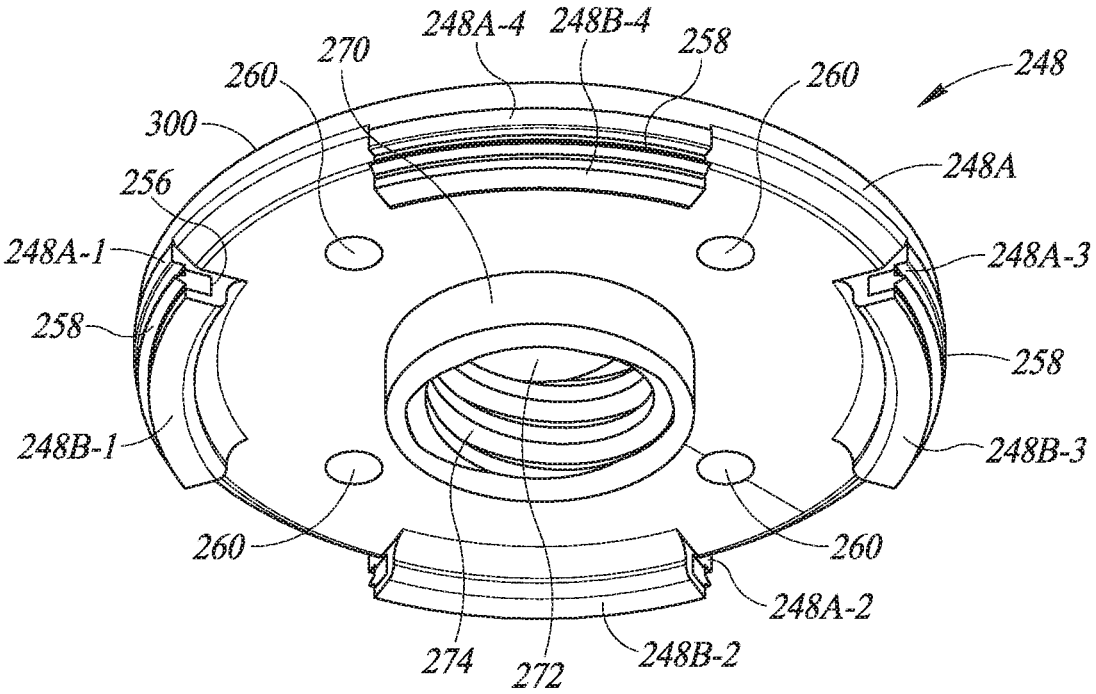
FIG. 25 is a bottom perspective exploded view of a lower member of the seal assembly of the drink container of FIG. 9.

The perimeter lower member portion 246B of the upper member 246 has a smaller diameter than the perimeter upper member portion 246A and is sized to pass by the upper edge wall 242 of the recess 240 to position the wall 254 of the perimeter middle member portion 246C inward of the recess. The ring seal 250 is shown in FIGS. 19 and 20 with the lid 214 in the second (opened) position mounted on and extending about the wall 252 of the perimeter lower member portion 246B of the upper member 246 at a vertical position directly opposite the recess 240 and inward of the recess. In this position the ring seal 250 is in an initial perimeter position and has an initial interior diameter/perimeter the same size as the exterior diameter/perimeter of the wall 252 and an initial exterior diameter/perimeter. As will be described below, the upper member 246 is movable upward and downward by the user relative to the lower member 248, and during that movement the ring seal 250 is movable upward and downward relative to the upper member 246 between the wall 252 of the perimeter lower member portion 246B and positions on the ramp wall 254 of the perimeter middle member portion 246C.

Figure 16:
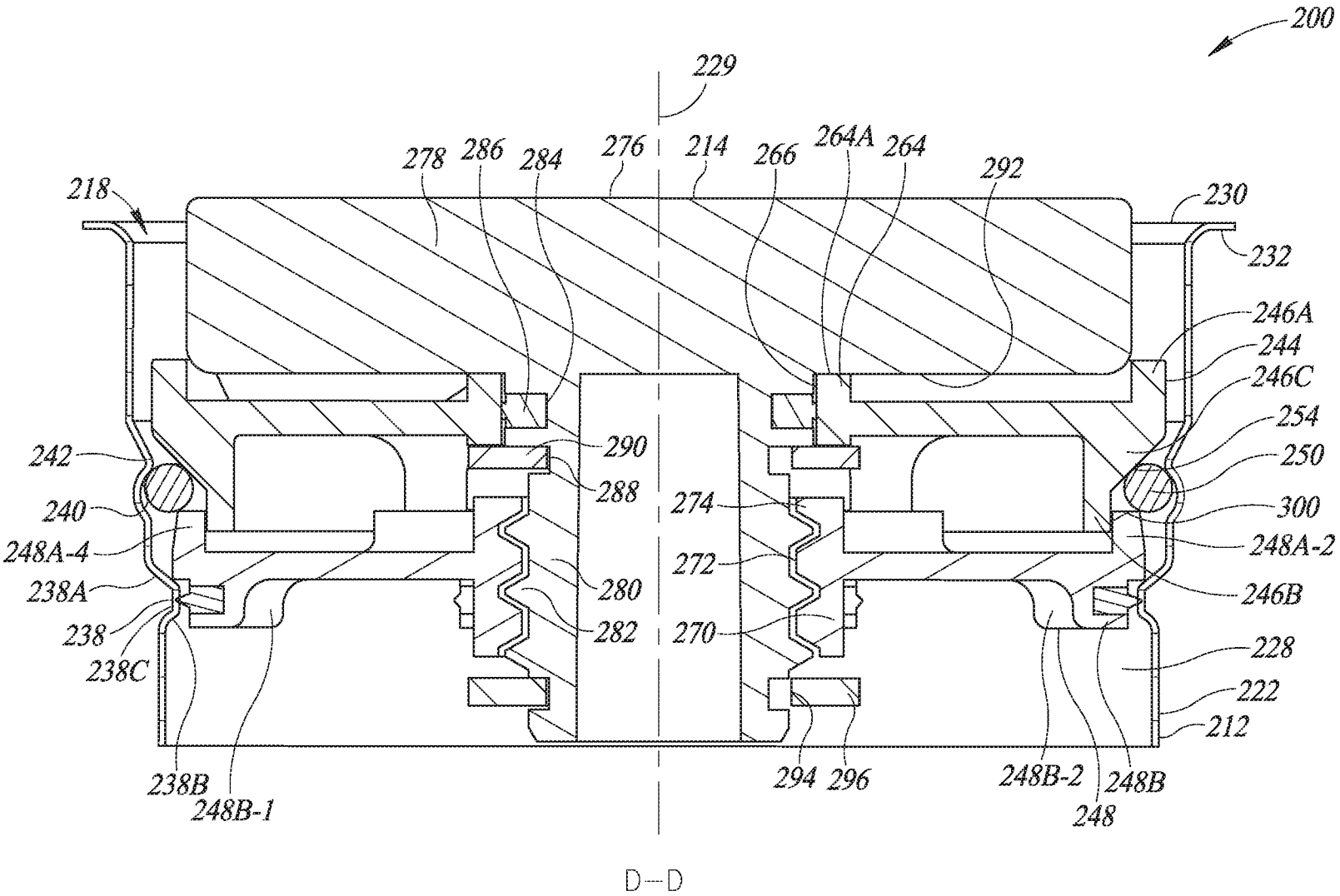
FIG. 16 is a cross-sectional view of the drink container of FIG. 9 with the plug lid in the intermediate operational position taken substantially along the line D-D of FIG. 10.
Figure 17:
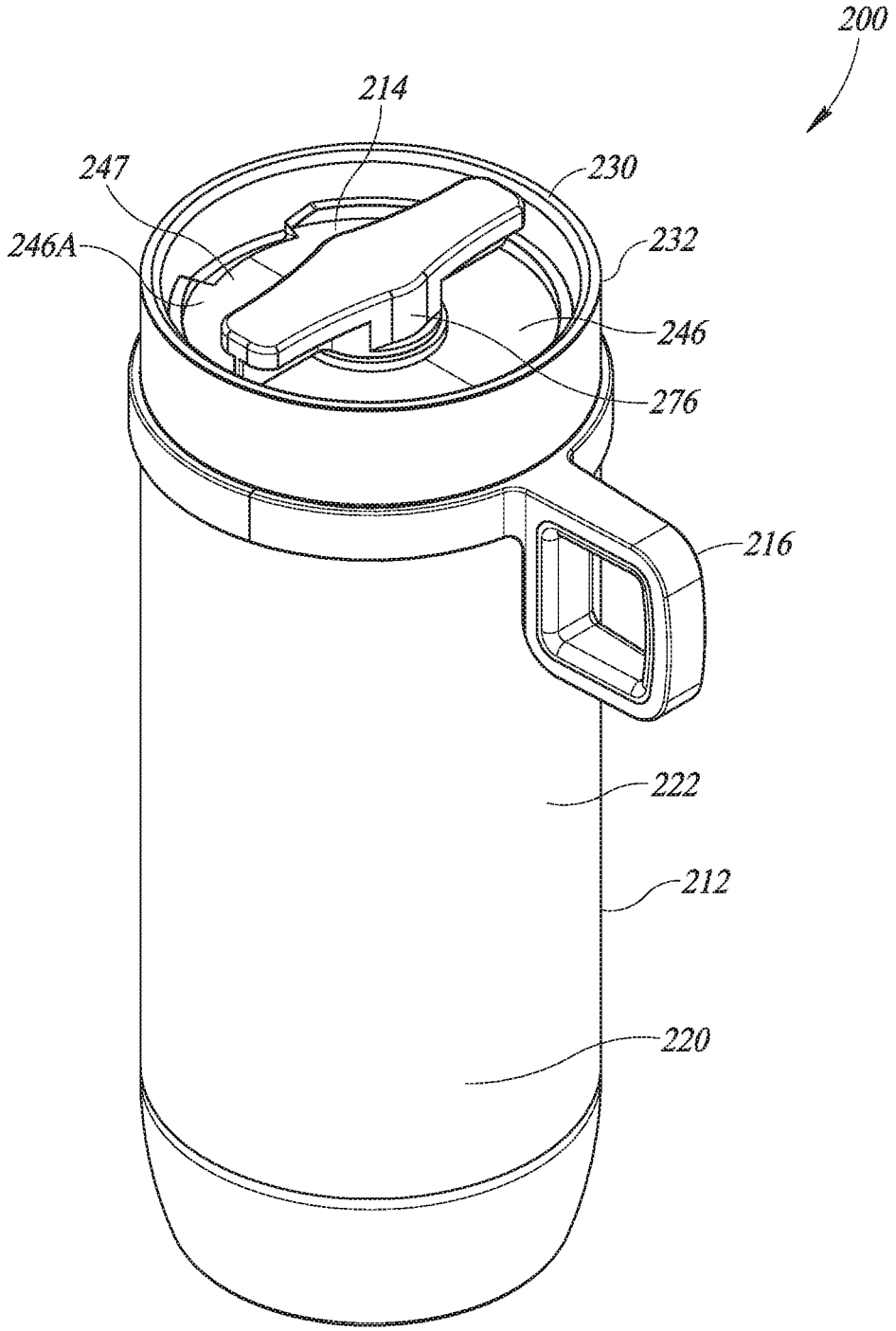
FIG. 17 is a top perspective view of the drink container of FIG. 9 with the plug lid in a closed operational position.
Figure 18:
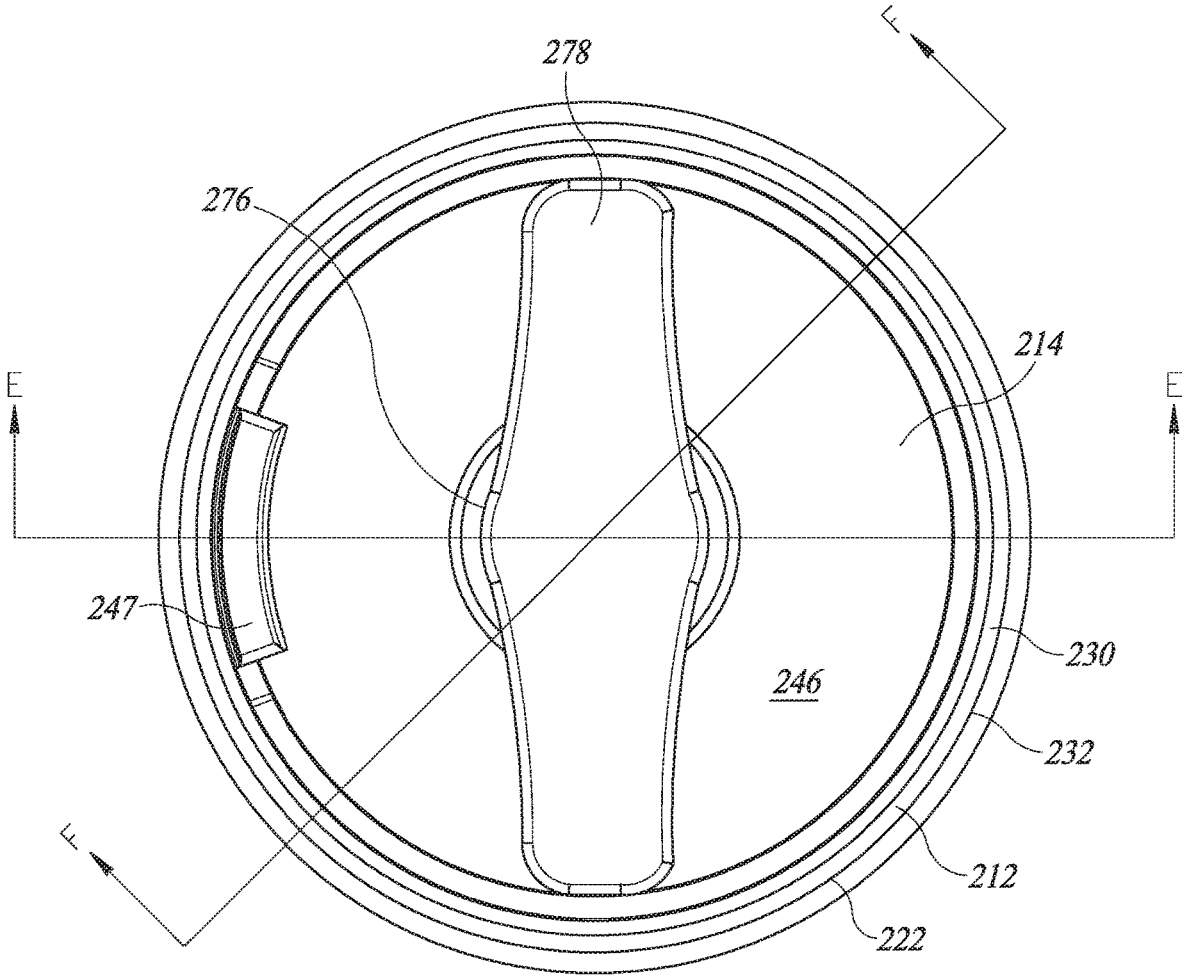
FIG. 18 is a top plan view of the drink container of FIG. 9 with the plug lid in the closed operational position.

The lower member 248 of the lid 214 has a circumferentially extending, perimeter upper member portion 248A, and a smaller diameter circumferentially extending, perimeter lower member portion 248B. The perimeter upper member portion 248A of the lower member 248 is sized to engage and be supported by the upper wall portion 238A of the body ridge 238 when the lid 214 is inserted by the user into the fluid passageway 228 through the upper end opening 230 to support the lower member 248 when within the fluid passageway and limit its downward movement. In the illustrated embodiment, the perimeter upper member portion 248A has four circumferentially extending, spaced-apart perimeter wall sections 248A-1, 248A-2, 248A-3 and 248A-4, each sized and positioned to engage and be supported by the upper wall portion 238A of the body ridge 238 when the lid 214 is inserted by the user into the fluid passageway 228, as best shown in FIGS. 12, 16 and 20.

The perimeter lower member portion 248B has a smaller diameter than the perimeter upper member portion 248A and is sized to pass by the upper wall portion 238A of the body ridge 238 and reside within the fluid passageway 228 opposite the middle wall portion 238C of the body ridge. In the illustrated embodiment, the perimeter lower member portion 248B has four circumferentially extending, spaced-apart perimeter wall sections 248B-1, 248B-2, 248B-3 and 248B-4, each having a circumferentially extending groove 256, within which is positioned a friction member 258 sized to frictionally engage the middle wall portion 238C with sufficient frictional force to resist upward movement of the lower member 248 as the lid 214 is operated to move between its first (closed) and second (opened) states, and when the drink container 200 is tilted for drinking. However, the frictional force is not so great as to prevent the user from manually moving the lower member 248 and the entire lid 214 upward for removal of the lid from the body 212 for filling the lower body portion 220 with a liquid or for washing the lid and/or the body. The spaced-apart perimeter wall sections 248B-1, 248B-2, 248B-3 and 248B-4 of the perimeter lower member 248B are positioned immediately below and coextensive with the spaced-apart perimeter wall sections 248A-1, 248A-2, 248A-3 and 248A-4 of the perimeter upper member portion 248A.

Inward of the perimeter upper member portion 248A, the lower member 248 has four circumferentially distributed apertures 260, each sized to slidably received one of four correspondingly positioned vertically oriented, elongated guide members 262 of the upper member 246 when the upper and lower members 246 and 248 are assembled. The slidable positioning of the guide members 262 in the apertures 260 prevents rotation of the upper member 246 relative to the lower member 248 as the upper member is moved upward and downward by the user relative to the lower member to move the lid 214 between its first (closed) and second (opened) states.

To provide for upward and downward movement of the upper member 246 relative to the lower member 248, the upper member has a central collar portion 264 with an axially oriented opening 266 having a smooth interior sidewall 268. The lower member 248 of the lid 214 also has a central collar portion 270 with an axially oriented opening 272, in axial alignment with the opening 266 of the upper member 246. The opening 272 has an interior wall with a screw thread 274.

The lid 214 further includes an axially oriented, manually operable actuator member 276 with a manually gripable handle 278 at an upper end thereof and with a lower end portion 280 exteriorly threaded with an exterior screw thread 282 matching the threading of the interior screw thread 274 of the opening 272 of the lower member 248. When the lid 214 is assembled, the actuator member 276 extends through the smooth sidewall opening 266 of the upper member 246 and the threaded opening 272 of the lower member 248 which threadably receives the threaded lower end portion 280 of the actuator member. An upper portion of the actuator member 276, below the handle 278 and above the threaded lower end portion 280, has a first circumferentially extending groove 284 sized to receive a ring seal 286. When the lid 214 is assembled, the seal 286 is located within the opening 266 of the upper member 246 and in fluid-tight sealing engagement with the smooth interior sidewall 268.

A second circumferentially extending groove 288 is provided in the lower end portion 280 of the actuator member 276, below the first groove 284 and above the screw thread 282 of the lower end portion, and sized to receive a first C-clip 290. When the lid 214 is assembled, the first C-clip 290 is located below the collar portion 264 of the upper member 246 to allow rotational movement of the actuator member relative to the upper member 246 and to carry the upper member upward with the actuator member when the actuator member moves upward relative to the lower member 248. The handle 278 of the actuator member 276 has a circumferentially extending lower end wall 292 positioned above the first groove 284 and in sliding engagement with an upper end 266A of the collar portion 264 of the upper member 246 when the lid 214 is assembled to allow rotational movement of the actuator member relative to the upper member 246 and to trap the collar portion 264 between the end wall and the first C-clip 290. In such manner the actuator member 276 and the upper member 246 travel upward and downward together, but the actuator member is rotatable relative to the upper member to control the position of the upper member along the longitudinal axis 229 relative to the lower member 248.

A third circumferentially extending groove 294 is provided in the lower end portion 280 of the actuator member 276 below the screw thread 282 of the lower end portion, and sized to receive a second C-clip 296. When the lid 214 is assembled, the second C-clip 296 is located below the collar portion 270 of the lower member 246 to allow rotational movement of the actuator member 276 relative to the lower member 248 while limiting the upward movement of the actuator member within the collar portion 270 resulting from rotation of the actuator member.

The first C-clip 290 and the second C-clip 296 are axially spaced apart to allow sufficient axial movement of the actuator member 276, and hence the upper member 246 which moves with the upper member, relative to the lower member 248 to move the lid 214 fully between its first (closed) and second (opened) states resulting from rotation of the actuator member 276 relative to the lower member 248. When the actuator member 276 is rotated in a first rotational direction (counter-clockwise when viewed from above in the illustrated embodiment), the threaded engagement of the actuator member screw thread 282 with the interior screw thread 274 of the lower member moves the upper member 246 upward relative to the lower member 248 and hence moves the lid 214 toward the its second (opened) state shown in FIGS. 17-20, and when the actuator member is rotated in an opposite second rotational direction (clockwise), the threaded engagement of the actuator member screw thread with the interior screw thread of the lower member moves the upper member downward relative to the lower member and hence moves the lid 214 toward the its first (closed) state shown in FIGS. 9-12. The total axial movement of the upper member 246 relative to the lower member 248 being no greater than the axial spacing between the first and second C-clips 290 and 296.

When the lid 214 is positioned within the fluid passageway 228, the upper member 246, the lower member 248, the ring seal 250 and the actuator member 272 are coaxially arranged within the fluid passageway and in axial alignment with the longitudinal axis 229. Since the body 212 in the illustrated embodiment is cylindrical, the upper member 246 and lower member 248 are generally disk shaped to correspond to the interior shape of the interior fluid passageway 228 within which the lid 214 is positioned.

The lid 214 is shown in FIGS. 17-20 in its second (opened) state with the ring seal 250 in position on the wall 252 of the perimeter lower member portion 246B of the upper member 246 in a location directly opposite and spaced inward of the recess 240 of the upper body portion 222 of the body 212. When the lid 214 is in this state, a circumferentially extending gap 298 exists between the upper body portion 222 of the body 212 and the ring seal 250, and also between the upper body portion and the upper member 246 of the seal assembly 244. Liquid in the lower body portion 220 may pass through the gap 298 when the drink container 200 is sufficiently tilted, and be dispensed through the drink dispensing aperture 247 for drinking by the user. It is noted that while the perimeter wall sections of 248B-1, 248B-2, 248B-3 and 248B-4 of the perimeter lower member 248B are in contact with the middle wall portion 238C of the body ridge 238 when the lid 214 is in its second (opened) state, the spaces between these perimeter wall sections are unobstructed and liquid in the lower body portion 220 may pass through those spaces. To achieve the second (opened) state, the actuator member 276 is rotated in the first rotational direction to move the upper member 246 axially upward away from the lower member 248.

The lid 214 is shown in FIGS. 9-12 in its first (closed) state with the ring seal 250 in a seated position in the recess 240 of the upper body portion 222 of the body 212. In this position the gap 298 is completely closed and the ring seal is in fluid-tight sealing engagement with the upper body portion 222 of the body 212, thus preventing the passage of liquid in the lower body portion 220 to the drink dispensing aperture 247 and generally to the upper end opening 230 of the interior fluid passageway 228 of the upper body portion. To achieve the first (closed) state, the actuator member 276 is rotated in the second rotational direction to move the upper member 246 axially downward closer to the lower member 248.

When the lid 214 is in its second (opened) state shown in FIGS. 17-20 with the ring seal 250 in position on the wall 252 of the perimeter lower member portion 246B of the upper member 246, the ring seal is located immediately above a circumferentially extending, upwardly facing upper end wall 300 of the perimeter upper member portion 248A of the lower member 248 and has its initial interior diameter which is the same size as the exterior diameter of the wall 252 of the upper member 246 and an initial cross-sectional size. The end wall 298 serves as a stop member to limit downward movement of the ring seal 250 as will be described below. To move the lid 214 toward the first (closed) state, the actuator member 276 is rotated in the second rotational direction which moves the upper member 246 axially downward toward the lower member 248 as a result of the threaded engagement of the actuator member screw thread 282 with the interior screw thread 274 of the lower member.

As the upper member 246 moves downward, a downward force is applied to the ring seal 250, which is positioned on the wall 252 of the perimeter lower member portion 246B of the upper member 246, to carry the ring seal downward into engagement with the upper end wall 300 of the perimeter upper member portion 248A of the lower member 248 if not already in such engagement. Engagement of the ring seal 250 with the upper end wall 300 prevents any further downward movement of the ring seal. As a result, the continued downward movement of the upper member 246 toward the lower member 248 as the ring seal 250 is held stationary moves the wall 252 downward, eventually enough to move it out of the interior of the ring seal and move a lower end portion 254A the ramp wall 254 into the interior of the ring seal.

The downward force continues to be applied by the ramp wall 254 as the upper member 246 continues to move downward. As the ramp wall 254 moves farther downward relative to the ring seal 250, a progressively larger diameter portion of the ramp wall is positioned within the interior of the ring seal, thus applying an outwardly directed radial stretching force to the ring seal which progressively stretching the ring seal radially outward from its initial perimeter position and circumferentially stretching the ring seal and increasing the ring seal's circumference/perimeter and diameter/width until eventually the ring seal is moved radially outward from its initial perimeter position to a sealing perimeter position in the recess 240 and in fluid-tight sealing engagement with the upper body portion 222 of the body 212, whereat the ring seal has a sealing interior diameter/perimeter and a sealing exterior diameter/perimeter, as well as a cross-sectional size smaller than its initial cross-sectional size. When the ring seal 250 is so positioned, the lid 214 is in its first (closed) state shown in FIGS. 9-12.

The lower member 248 has a circumferentially extending, upwardly opening recessed area 302 positioned inward of the perimeter upper member portion 248A to receive therein the perimeter lower member portion 246B of the upper member 246 as the upper member 246 moves axially downward toward the lower member 248. The recessed area 302 is sufficiently large and deep to avoid the downward movement of the perimeter lower member portion 246B from coming into engagement with the upper end wall 300 of the perimeter upper member portion 248A before the ring seal 250 is sufficiently outwardly stretched to be moved sufficiently into the recess 240 to be in fluid-tight sealing engagement with the upper body portion 222 of the body 212.

It is noted that when the user rotates the actuator member 276 in the second rotational direction to move the upper member 246 downward toward the lower member 248, and thereby move the lid 214 toward the first (closed) state, the lower member is held in a stationary position relative to the body 212 of the drink container 200 against any upward movement by the friction members 258 of the perimeter wall sections 248B-1, 248B-2, 248B-3 and 248B-4 frictionally engaging the middle wall portion 238C of the body ridge 238, as well as by the user tending to apply a downward force on the actuator member when rotating it. Additionally, it is noted that rotation of the actuator member 276 moves the upper member 246 axially relative to the stationary lower member 248 without any rotational movement of the upper member relative to the lower member as a result of the guide members 262 of the upper member being slidably received in the apertures 260 of the lower member.

When the lid 214 is in its first (closed) state shown in FIGS. 9-12 with the ring seal 250 within the recess 240 and in fluid-tight sealing engagement with the upper body portion 222 of the body 212, to move the lid toward the second (opened) state, the actuator member 276 is rotated in the first rotational direction which moves the upper member 246 axially upward away from the lower member 248, as a result of the threaded engagement of the actuator member screw thread 282 with the interior screw thread 274 of the lower member. As the upper member 246 moves upward, the ring seal 250, which is positioned within the recess 240, is at least initially prevented from moving upward with the upper member by the upper edge wall 242 of the recess which is located above the ring seal and protrudes over the ring seal and inwardly into the fluid passageway 228. As the upper member 246 moves upward relative to the ring seal 250, the ramp wall 254 extending through the interior of the ring seal also moves upward, and the farther the ramp wall moves upward the smaller the diameter of the portion of the ramp wall positioned within the interior of the ring seal which allows the outwardly stretched resilient ring seal to progressively relax radially inward and decrease its circumference and diameter until eventually the ring seal clears the upper edge wall 242 of the recess 240 and can be carried upward with the ramp wall, whereat the ring seal has returned substantially to the initial interior diameter and the initial exterior diameter, as well as to the initial cross-sectional size. In a preferred embodiment, the upper edge wall 242 of the recess 240 holds the ring seal 250 against upward movement until the upper member 246 has moved sufficiently upward to return the ring seal to a position on the wall 252 of the perimeter lower member portion 246B of the upper member 246. However, even if that does not occur and the ring seal 250 clears the upper edge wall 242 while still positioned on the ramp wall 254 and is carried slightly upward away from the upper end wall 298 of the perimeter upper member portion 248A of the lower member 248, when the user next rotates the actuator member 276 in the second rotational direction to move the upper member 246 downward, the ramp wall 254 will carry the ring seal 250 downward with it until it engages the upper end wall 300 of the perimeter upper member portion 248A of the lower member 248, thus locating the ring seal directly opposite and spaced inward of the recess 240 of the upper body portion 222 of the body 212 for again progressively outwardly stretching the ring seal outward and eventually into the fluid-tight sealing position in the recess 240.

The lid 214 is show in FIGS. 13-16 in the intermediate position through which the lid passes as it is moved between the first (closed) state shown in FIGS. 9-12 and the second (opened) state shown in FIGS. 17-20. In the illustrated intermediate position the ring seal 250 is not fully seated within the recess 240. From this intermediate position, rotation of the actuator member 276 in the first rotational direction will move the upper member 246 axially upward away from the lower member 248 and allow the ring seal 250 to relax and pull farther away from the recess 240 as the lid moves toward its second (opened) state, and rotation of the actuator member in the second rotational direction will move the upper member axially downward toward the lower member and cause the ring seal to stretch outward and move into the fluid-tight sealing position in the recess in fluid-tight sealing engagement with the upper body portion 222 of the body 212.

While the perimeter middle member portion 246C is described and illustrated as having a circumferentially extending, outward facing perimeter smooth ramp wall 254 with the shape of a conical wall section to provide a smooth and progressive expansion of the ring seal 250 from its relaxed state to its stretched state in fluid-tight sealing engagement with the upper body portion 222, it will be recognized by a person of skill in the art that the wall 254 may have other contours which stretch the ring seal as the actuator member 276 moves the upper member 246 away from the lower member 248 which do not utilize a smooth ramp wall or even a conical wall section. Such alternative shapes may be used so long as the ring seal 250 is in a sufficiently stretched state that it provided a fluid-tight sealing engagement with the upper body portion 222 when in the lid is in the first (closed) state and is sufficiently relaxed to provide the gap 298 between the upper body portion 222 of the body 212 and the ring seal 250 to permit fluid flow from the lower body portion 220 through the lid 214 to the drink aperture 247 or other portion of the lid intended to dispense the fluid.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare statement of "two recitations," without other modifiers, typically means at least two recitations, or two or more recitations).

What is claimed is:

1. A lid for use with a drink container body having an inner body portion defining an interior fluid passageway with an upper end opening, the lid when in a lid operational position in the fluid passageway being operable to open and close fluid flow through the fluid passageway, comprising:

an upper member positionable in the fluid passageway, the upper member being upwardly and downwardly movable within the fluid passageway between an upper position and a lower position, with the movement therebetween unrestrained by the inner body portion of the drink container body when the lid is in the lid operational position in the fluid passageway;

a lower member positionable in the fluid passageway in position below the upper member, the lower member being stationary within the fluid passageway as the upper member moves between the upper position and the lower position when the lid is in the lid operational position in the fluid passageway;

a ring seal positioned between the upper member and the lower member, the ring seal being outward stretchable from an initial perimeter size when the upper member is in the upper position to a sealing perimeter larger size than the initial perimeter size when the upper member is in the lower position; and an actuator member movable to first and second operational positions, as the actuator member is moved from the second operational position to the first operational position, the actuator member moves the upper member downward from the upper position to the lower position to move the upper and lower members together without moving the lower member upward or downward, and in response, the upper member stretches the ring seal outward from the initial perimeter size to the sealing perimeter size whereat the stretched ring seal is in fluid-tight sealing engagement with the inner body portion to close fluid flow through the fluid passageway when the lid is in the lid operational position in the fluid passageway, and as the actuator member is moved from the first operational position to the second operational position, the actuator member moves the upper member upward from the lower position to the upper position to move the upper and lower members apart without moving the lower member upward or downward, and in response, the upper member allows the outwardly stretched ring seal to move inward from the sealing perimeter size to the initial perimeter size whereat the ring seal is out of fluid-tight sealing engagement with the inner body portion to open fluid flow through the fluid passageway when the lid is in the lid operational position in the fluid passageway.

2. The lid of claim 1, further including a gripper member attached to the lower member and sized to engage the inner body portion when the lid is in the lid operational position in the fluid passageway with sufficient force to inhibit removal of the lid from the fluid passageway under the weight of the lid if the drink container body is turned upside down without preventing fluid flow through the fluid passageway, the gripper member being positioned below the ring seal.

3. The lid of claim 1, wherein the ring seal is an O-ring.

4. The lid of claim 1, wherein the upper member has a drink dispensing aperture, and when the actuator member moves the upper and lower members together to stretch the ring seal outward to the sealing perimeter size, drink in the container body below the upper member is prevented from being dispensed through the drink dispensing aperture when the container body is tilted.

5. The lid of claim 4, wherein when the actuator member moves the upper and lower members apart to allow the stretched ring seal to move inward from the sealing perimeter size to the initial perimeter size, drink in the container body below the upper member is allowed to be dispensed through the drink dispensing aperture when the container body is tilted.

6. The lid of claim 1, wherein the upper member is retained against rotation relative to the lower member.

7. The lid of claim 6, wherein the actuator member is a threaded member having an upper actuator portion and a threaded lower actuator portion, the upper member being attached to the upper actuator portion for axial movement therewith while being rotatably disconnected from the upper actuator portion, the threaded lower actuator portion being threadably engaged with the lower member such that rotation of the threaded member in a first rotational direction axially moves the upper member upward away from the lower member, and rotation of the threaded member in a second rotational direction opposite to the first rotational direction axially move the upper member downward toward the lower member.

8. The lid of claim 1, wherein the actuator member is a threaded member having an upper actuator portion and a threaded lower actuator portion, the upper member being attached to the upper actuator portion for axial movement therewith, and the threaded lower actuator portion being threadably engaged with the lower member such that rotation of the threaded member in a first rotational direction axially moves the upper member upward away from the lower member, and rotation of the threaded member in a second rotational direction opposite to the first rotational direction axially move the upper member downward toward the lower member.

9. The lid of claim 1, wherein as the actuator member is moved from the second operational position to the first operational position, the actuator member axially moves the upper member downward from the upper position to the lower position, and in response, the upper member stretches the entire ring seal outward from the initial perimeter size to the sealing perimeter size whereat the stretched ring seal is in fluid-tight sealing engagement with the inner body portion, and as the actuator member is moved from the first operational position to the second operational position, the actuator member axially moves the upper member upward from the lower position to the upper position, and in response the upper member allows the entire outwardly stretched ring seal to move inward from the sealing perimeter size to the initial perimeter size whereat the ring seal is out of fluid-tight sealing engagement with the inner body portion.

10. The lid of claim 1, wherein the ring seal extends about a ring seal central aperture, the upper member has a circumferentially extending, outward facing perimeter ramp wall sloping upward in the outward direction, and as the actuator member is moved from the second operational position to the first operational position, the upper member is moved downward while to the lower member remains stationary, and as the upper member moves downward, the ramp wall extends through the ring seal central aperture and engages the ring seal, and as a progressively larger diameter portion of the ramp wall is positioned within the ring seal central aperture the ramp wall applies an outwardly directed stretching force to the ring seal which progressively stretches the entire ring seal radially outward from the initial perimeter size toward the sealing perimeter size.

11. The lid of claim 1, wherein the entire ring seal is in operational engagement with and disconnected from the upper and lower members.

12. The lid of claim 1, wherein as the actuator member is moved from the second operational position to the first operational position, the upper member is moved downward from the upper position to the lower position while the lower member remains stationary and the entire ring seal is movable vertically relative to the upper member during which the upper member stretches the entire ring seal radially outward from the initial perimeter size toward the sealing perimeter size.

13. The lid of claim 1 for use with the drink container body having an interior, inwardly opening, circumferentially extending upper body recess within the fluid passageway at a location below the upper end opening, the upper body recess extending continuously about the internal circumference of the inner body portion and serving as a seal seat, wherein when the actuator member moves the upper member downward, the upper member stretches the ring seal outward into the upper body recess whereat the ring seal is in fluid-tight sealing engagement with the inner body portion when stretched into the sealing perimeter size.

14. The lid of claim 1, wherein the ring seal has a first cross-sectional size when having the initial perimeter size, and has a second cross-sectional size smaller than the first cross-sectional size when stretched outward by the upper member from the initial perimeter size to the sealing perimeter size.

15. A drink container, comprising:

a container body having an inner body portion defining an interior fluid passageway with an upper end opening; and a lid sized to permit insertion into and removal from the fluid passageway through the upper end opening, the lid when in a lid operational position in the fluid passageway being operable to open and close fluid flow through the fluid passageway and having:

an upper member positioned in the fluid passageway, the upper member being upwardly and downwardly movable within the fluid passageway between an upper position and a lower position, with the movement therebetween unrestrained by the inner body portion of the drink container body;

a lower member positioned in the fluid passageway in position below the upper member, the lower member being stationary within the fluid passageway as the upper member moves between the upper position and the lower position;

a ring seal positioned between the upper member and the lower member, the ring seal being outwardly stretchable from an initial perimeter size when the upper member is in the upper position to a sealing perimeter size larger than the initial perimeter size when the upper member is in the lower position; and an actuator member movable to first and second operational positions, in response to the actuator member moving from the second operational position to the first operational position, the actuator member moves the upper member downward from the upper position to the lower position to move the upper and lower members together without moving the lower member upward or downward, and in response, the upper member stretches the ring seal outward from the initial perimeter size to the sealing perimeter size whereat the stretched ring seal is in fluid-tight sealing engagement with the inner body portion to close fluid flow through the fluid passageway, and in response to the actuator member moving from the first operational position to the second operational position, the actuator member moves the upper member upward from the lower position to the upper position to move the upper and lower members apart without moving the lower member upward or downward, and in response, the upper member allows the outward stretched ring seal to move inward from the sealing perimeter size to the initial perimeter size whereat the ring seal is out of fluid-tight sealing engagement with the inner body portion to open fluid flow through the fluid passageway.

16. The drink container of claim 15, further including a gripper member attached to the lower member and sized to engage the inner body portion with sufficient force to inhibit removal of the lid from the fluid passageway under the weight of the lid if the drink container body is turned upside down without preventing fluid flow through the fluid passageway, the gripper member being positioned below the ring seal.

17. The drink container of claim 15, wherein the ring seal is an O-ring.

18. The drink container of claim 15, wherein the upper member has a drink dispensing aperture, and when the actuator member moves the upper and lower members together to stretch the ring seal outward to the sealing perimeter, drink in the container body below the upper member is prevented from being dispensed through the drink dispensing aperture when the container body is tilted.

19. The drink container of claim 15, wherein the container body has an interior, inwardly opening, circumferentially extending upper body recess within the fluid passageway at a location below the upper end opening, the upper body recess extending continuously about the internal circumference of the inner body portion and serving as a seal seat, the upper body recess being positioned to receive the ring seal therein in fluid-tight sealing engagement with the inner body portion when the ring seal is in the sealing perimeter position within upper body recess.

20. The drink container of claim 15, wherein the ring seal has a first cross-sectional size when having the initial perimeter size, and has a second cross-sectional size smaller than the first cross-sectional size when stretched outward by the upper member from the initial perimeter size to the sealing perimeter size.

21. The drink container of claim 15, wherein the container body has an interior, inwardly projecting, circumferentially extending body ridge within the fluid passageway at a location below the upper end opening, and the lower member has an outwardly projecting, circumferentially extending, first perimeter lower member portion, the first perimeter lower member portion being sized to engage and be supported by the body ridge when the lid is inserted into the fluid passageway through the upper end opening to limit the downward movement of the lower member.

22. The drink container of claim 21, wherein the lower member has an outwardly projecting, circumferentially extending, second perimeter lower member portion, the second perimeter lower member portion being positioned below the first perimeter lower member portion and sized to be positioned inward of the body ridge when the lid is inserted into the fluid passageway through the upper end opening, the second perimeter lower member portion having a gripper member attached thereto, the gripper member being sized to engage the body ridge with sufficient force to resist movement of the lower member as the actuator member moves the upper member downward and upward.

23. The drink container of claim 21, wherein the lower member has an outwardly projecting, circumferentially extending, second perimeter lower member portion, the second perimeter lower member portion being positioned below the first perimeter lower member portion and sized to be positioned inward of the body ridge when the lid is inserted into the fluid passageway through the upper end opening, the second perimeter lower member portion having a plurality of circumferentially extending, circumferentially spaced-apart perimeter wall sections, each of the plurality of perimeter wall sections having a gripper member attached thereto, the gripper members being sized to engage the body ridge with sufficient force to resist movement of the lower member as the actuator member moves the upper member downward and upward.

24. The drink container of claim 23, wherein the plurality of perimeter wall sections have circumferentially distributed spaces therebetween sized to permit fluid flow in the fluid passageway to pass therethrough.

25. A lid for use with a drink container body having an inner body portion defining an interior fluid passageway with an upper end opening, the lid when in a lid operational position in the fluid passageway being operable to open and close fluid flow through the fluid passageway, comprising:

an upper member positionable in the fluid passageway and having a tapered portion tapering inwardly in the downward direction, the upper member being upwardly and downwardly movable within the fluid passageway between an upper position and a lower position when the lid is in the lid operational position in the fluid passageway;

a lower member positionable in the fluid passageway in position below the upper member, the lower member being stationary within the fluid passageway as the upper member moves between the upper position and the lower position when the lid is in the lid operational position in the fluid passageway;

a ring seal having a central aperture and being positioned on and extending about the upper member, the entire ring seal being outwardly stretchable from an initial perimeter size to a sealing perimeter size larger than the initial perimeter size in response to the inwardly tapered portion of the upper member engaging the ring seal and stretching the entire ring seal outward toward the sealing perimeter size as the inwardly tapered portion is moving downward through the central aperture of the ring seal; and an actuator member movable to first and second operational positions, in response to the actuator member moving from the second operational position to the first operational position, the actuator member moves the upper member downward from the upper position to the lower position without moving the lower member upward or downward, to progressively move larger perimeter portions of the inwardly tapered portion of the upper member into the central aperture of the ring seal and thereby outwardly stretch the entire ring seal from the initial perimeter size to the sealing perimeter size whereat the stretched ring seal is in fluid-tight sealing engagement with the inner body portion to close fluid flow through the fluid passageway when the lid is in the lid operational position in the fluid passageway.

26. The lid of claim 25, wherein in response to the actuator member moving from the first operational position to the second operational position, the actuator member moves the upper member upward from the lower position to the upper position without axially moving the lower member upward or downward, to progressively move upward smaller perimeter portions of the inwardly tapered portion positioned into the central aperture of the ring seal and thereby allow the entire ring seal to inwardly contract from the sealing perimeter size to the initial perimeter size whereat the ring seal is out of fluid-tight sealing engagement with the inner body portion to open fluid flow through the fluid passageway when the lid is in the lid operational position in the fluid passageway.

27. The lid of claim 25, further including a gripper member connected to the lower member and sized to engage the inner body portion when the lid is in the lid operational position in the fluid passageway with sufficient force to inhibit removal of the lid from the fluid passageway under the weight of the lid if the drink container body is turned upside down without preventing fluid flow through the fluid passageway.

28. The lid of claim 25, wherein the ring seal is an O-ring.

29. The lid of claim 25, wherein the upper member has a drink dispensing aperture, and when the ring seal is outwardly stretched into fluid-tight sealing engagement with the inner body portion, drink in the container body below the upper member is prevented from being dispensed through the drink dispensing aperture when the container body is tilted.

30. The lid of claim 29, wherein when the ring seal has inwardly contracted from the sealing perimeter size to the initial perimeter size, drink in the container body below the upper member is allowed to be dispensed through the drink dispensing aperture when the container body is tilted.

31. The lid of claim 25, wherein the upper member is retained against rotation relative to the lower member.

32. The lid of claim 31, wherein the actuator member is a threaded member having an upper actuator portion and a threaded lower actuator portion, the upper member being attached to the upper actuator portion for axial movement therewith while being rotatably disconnected from the upper actuator portion, the threaded lower actuator portion being threadably engaged with the lower member such that rotation of the threaded member in a first rotational direction axially moves the upper member upward away from the lower member, and rotation of the threaded member in a second rotational direction opposite to the first rotational direction axially move the upper member downward toward the lower member.

33. The lid of claim 31, wherein the actuator member is a threaded member having an upper actuator portion and a threaded lower actuator portion, the upper member being attached to the upper actuator portion for axial movement therewith, and the threaded lower actuator portion being threadably engaged with the lower member such that rotation of the threaded member in a first rotational direction axially moves the upper member upward away from the lower member, and rotation of the threaded member in a second rotational direction opposite to the first rotational direction axially move the upper member downward toward the lower member.

34. The lid of claim 25, wherein the ring seal has a first cross-sectional size when having the initial perimeter size, and has a second cross-sectional size smaller than the first cross-sectional size when stretched outward by the upper member from the initial perimeter size to the sealing perimeter size.

35. A lid for use with a fluid container body having an inner body portion defining an interior fluid passageway with an upper end opening, comprising:

an upper member positionable within the fluid passageway for upward and downward movement within the fluid passageway during operation of the lid for opening and closing fluid flow within the fluid passageway and having a tapered portion tapering inwardly in the downward direction;

a lower member positionable within the fluid passageway in position below the upper member, the lower member being stationary within the fluid passageway as the upper member moves upward and downward within the fluid passageway during operation of the lid;

a ring seal having a central aperture and being positioned on and extending about the upper member, the ring seal being outwardly stretchable from an initial perimeter position to a sealing perimeter position outward of the initial perimeter position in response to the inwardly tapered portion of the upper member engaging the ring seal and stretching the entire ring seal outward as the inwardly tapered portion is moving downward through the central aperture of the ring seal; and an actuator member movable to first and second operational positions, in response to the actuator member moving from the second operational position to the first operational position, the actuator member moves the upper member downward toward the lower member without moving the lower member, to progressively move larger perimeter portions of the inwardly tapered portion of the upper member into the central aperture of the ring seal and thereby outwardly stretch the entire ring seal from the initial perimeter position whereat the ring seal is out of fluid-tight sealing engagement with the inner body portion when the lid is positioned in the fluid passageway to the sealing perimeter position whereat the stretched ring seal is in fluid-tight sealing engagement with the inner body portion when the lid is positioned in the fluid passageway.

36. The lid of claim 35, wherein in response to the actuator member moving from the first operational position to the second operational position, the actuator member moves the upper member upward away from the lower member without moving the lower member, to progressively move smaller perimeter portions of the inwardly tapered portion into the central aperture of the ring seal and thereby allow the entire ring seal to inwardly contract from the sealing perimeter position to the initial perimeter position.

37. The lid of claim 35, further including a gripper member connected to the lower member and sized to engage the inner body portion when the lid is positioned in the fluid passageway with sufficient force to inhibit removal of the lid from the fluid passageway under the weight of the lid if the fluid container body is turned upside down.

38. The lid of claim 35, wherein the ring seal is an O-ring.

39. The lid of claim 35, wherein the upper member has a fluid dispensing aperture, and when the ring seal is outwardly stretched into fluid-tight sealing engagement with the inner body portion, fluid in the container body below the upper member is prevented from being dispensed through the fluid dispensing aperture when the container body is tilted.

40. The lid of claim 35, wherein the ring seal has a first cross-sectional size when in the initial perimeter position, and has a second cross-sectional size smaller than the first cross-sectional size when stretched outward by the upper member from the initial perimeter position to the sealing perimeter position.

41. A lid for use with a fluid container body having an inner body portion defining an interior fluid passageway with an upper end opening, the lid when in the fluid passageway being operable to open and close fluid flow through the fluid passageway, comprising:

an upper member positionable within the fluid passageway for upward and downward movement during operation of the lid;

a lower member positionable within the fluid passageway in position below the upper member, the lower member being stationary within the fluid passageway during operation of the lid;

a ring seal positioned between the upper member and the lower member, the ring seal being outward stretchable from an initial perimeter position to a sealing perimeter position outward of the initial perimeter position; and an actuator member movable to first and second operational positions, as the actuator member is moved from the second operational position to the first operational position, the actuator member moves the upper member downward toward the lower member without moving the lower member, and in response, the upper member stretches the ring seal outward to the sealing perimeter position whereat the stretched ring seal is in fluid-tight sealing engagement with the inner body portion to close fluid flow through the fluid passageway when the lid is positioned in the fluid passageway, and as the actuator member is moved from the first operational position to the second operational position, the actuator member moves the upper member upward away from the lower member without moving the lower member, and in response, the upper member allows the outwardly stretched ring seal to move inward to the initial perimeter position whereat the ring seal is out of fluid-tight sealing engagement with the inner body portion to open fluid flow through the fluid passageway when the lid is positioned in the fluid passageway.

42. The lid of claim 41, wherein the ring seal extends about a ring seal central aperture, the upper member has a circumferentially extending, outward facing perimeter ramp wall sloping upward in the outward direction, and as the actuator member is moved from the second operational position to the first operational position, the upper member is moved downward toward the lower member, and as the upper member moves downward toward the lower member, the ramp wall extends through the ring seal central aperture and engages the ring seal, and as a progressively larger diameter portion of the ramp wall is positioned within the ring seal central aperture the ramp wall applies an outwardly directed stretching force to the ring seal which progressively stretches the entire ring seal radially outward from the initial perimeter position toward the sealing perimeter portion.

43. The lid of claim 41, wherein the ring seal has a first cross-sectional size when in the initial perimeter position, and has a second cross-sectional size smaller than the first cross-sectional size when stretched outward by the upper member from the initial perimeter position to the sealing perimeter position.

44. A lid for use with a fluid container body having an inner body portion defining an interior fluid passageway with an upper end opening, comprising:

a ring seal being outwardly stretchable from an initial perimeter position to a sealing perimeter position outward of the initial perimeter position;

an actuator member movable between first and second operational positions; and stretching means for outwardly stretching the entire ring seal from the initial perimeter position whereat the ring seal is out of fluid-tight sealing engagement with the inner body portion when the lid is positioned in the fluid passageway to the sealing perimeter position whereat the stretched ring seal is in fluid-tight sealing engagement with the inner body portion when the lid is positioned in the fluid passageway, in response to the actuator member moving from the second operational position to the first operational position.

45. The lid of claim 44, wherein the stretching means further allows the entire ring seal to inwardly contract from the sealing perimeter position to the initial perimeter position, in response to the actuator member moving from the first operational position to the second operational position.

46. The lid of claim 44, wherein the ring seal has a first cross-sectional size when in the initial perimeter position, and has a second cross-sectional size smaller than the first cross-sectional size when stretched outward by the stretching means to the sealing perimeter position.

47. A lid for use with a fluid container body having an inner body portion defining an interior fluid passageway with an upper end opening, comprising:

a ring seal being outwardly movable from an initial perimeter position to a sealing perimeter position outward of the initial perimeter position;

an actuator member movable between first and second operational positions; and means for outwardly moving the entire ring seal from the initial perimeter position whereat the ring seal is out of fluid-tight sealing engagement with the inner body portion when the lid is positioned in the fluid passageway to the sealing perimeter position whereat the ring seal is in fluid-tight sealing engagement with the inner body portion when the lid is positioned in the fluid passageway, in response to the actuator moving from the second operational position to the first operational position.

48. The lid of claim 47, wherein the means further moves the entire ring seal from the sealing perimeter position to the initial perimeter position, in response to the actuator member moving from the first operational position to the second operational position.

49. The lid of claim 47, wherein the ring seal has a first cross-sectional size when in the initial perimeter position, and has a second cross-sectional size smaller than the first cross-sectional size when moved outward to the sealing perimeter position.

50. A lid for use with a fluid container body having an inner body portion defining an interior fluid passageway with an upper end opening, comprising:

a ring seal being outward stretchable from an initial perimeter to a sealing perimeter larger than the initial perimeter;

an actuator member movable between first and second operational positions; and stretching means for outwardly stretching the entire ring seal from the initial perimeter whereat the ring seal is out of fluid-tight sealing engagement with the inner body portion when the lid is positioned in the fluid passageway to the sealing perimeter whereat the stretched ring seal is in fluid-tight sealing engagement with the inner body portion when the lid is positioned in the fluid passageway, in response to the actuator moving from the second operational position to the first operational position.

51. The lid of claim 50, wherein the stretching means further allows the entire ring seal to inwardly contract from the sealing perimeter to the initial perimeter, in response to the actuator member moving from the first operational position to the second operational position.

52. The lid of claim 50, wherein the ring seal has a first cross-sectional size when having the initial perimeter, and has a second cross-sectional size smaller than the first cross-sectional size when stretched outward by the stretching means to the sealing perimeter.

53. A lid for use with a drink container body having an inner body portion defining an interior fluid passageway with an upper end opening, comprising:

an upper member positionable within the fluid passageway for upward and downward movement within the fluid passageway;

a lower member positionable within the fluid passageway adjacent to the upper member, the lower member being stationary within the fluid passageway as the upper member moves upward and downward within the fluid passageway;

a ring seal positioned between the upper member and the lower member, and being unclamped from both the upper and lower members, the entire ring seal being outward stretchable from a first perimeter size to a second perimeter size different than the first perimeter size; and means for selectively moving the upper member downward toward the lower member while the lower member remains stationary within the fluid passageway to change the entire ring seal from the first perimeter size to the second perimeter size and position the ring seal in fluid-tight sealing engagement with the inner body portion when the lid is positioned in the fluid passageway, and moving the upper member upward away from the lower member while the lower member remains stationary within the fluid passageway to change the entire ring seal from the second perimeter size to the first perimeter size and position the ring seal out of fluid-tight sealing engagement with the inner body portion when the lid is positioned in the fluid passageway.

54. The lid of claim 53, wherein the ring seal has a first cross-sectional size when having the first perimeter size, and has a second cross-sectional size smaller than the first cross-sectional size when changed to the second perimeter size.

55. A lid for use with a drink container body having an inner body portion defining an interior fluid passageway with an upper end opening, comprising:

an upper member positionable within the fluid passageway during operation of the lid;

a lower member positionable within the fluid passageway adjacent to the upper member during operation of the lid;

a ring seal positioned between the upper member and the lower member, and being unclamped from both the upper and lower members, the ring seal being outward stretchable from a first perimeter size to a second perimeter size different than the first perimeter size; and an actuator member operatively connected to the upper and lower members and operable to selectively move the upper member downward toward the lower member while the lower member remains stationary within the fluid passageway to change the entire ring seal from the first perimeter size to the second perimeter size and position the ring seal in fluid-tight sealing engagement with the inner body portion when the lid is positioned in the fluid passageway, and move the upper member upward away from the lower member while the lower member remains stationary within the fluid passageway to change the entire ring seal from the second perimeter size to the first perimeter size and position the ring seal out of fluid-tight sealing engagement with the inner body portion when the lid is positioned in the fluid passageway.

56. The lid of claim 55, wherein the upper member is retained against rotation relative to the lower member.

57. The lid of claim 56, wherein the actuator member is a threaded member having an upper actuator portion and a threaded lower actuator portion, the upper member being attached to the upper actuator portion for axial movement therewith while being rotatably disconnected from the upper actuator portion, the threaded lower actuator portion being threadably engaged with the lower member such that rotation of the threaded member in a first rotational direction axially moves the upper member upward away from the stationary lower member, and rotation of the threaded member in a second rotational direction opposite to the first rotational direction axially move the upper member downward toward the stationary lower member.

58. The lid of claim 55, wherein the actuator member is a threaded member having an upper actuator portion and a threaded lower actuator portion, the upper member being attached to the upper actuator portion for axial movement therewith, and the threaded lower actuator portion being threadably engaged with the lower member such that rotation of the threaded member in a first rotational direction axially moves the upper member upward away from the stationary lower member, and rotation of the threaded member in a second rotational direction opposite to the first rotational direction axially move the upper member downward toward the stationary lower member.

59. The lid of claim 55, wherein the ring seal extends about a ring seal central aperture, the upper member has a circumferentially extending, outward facing perimeter ramp wall sloping upward in the outward direction, and as the actuator member moves the upper member downward toward the lower member, the ramp wall extends through the ring seal central aperture and engages the ring seal, and as a progressively larger diameter portion of the ramp wall is positioned within the ring seal central aperture the ramp wall applies an outwardly directed stretching force to the ring seal which progressively stretches the entire ring seal radially outward from the first perimeter size toward the second perimeter size.

60. The lid of claim 55, wherein the ring seal has a first cross-sectional size when having the first perimeter size, and has a second cross-sectional size smaller than the first cross-sectional size when changed to the second perimeter size.

61. A lid for use with a drink container body having an inner body portion defining an interior fluid passageway with an upper end opening, the lid when in a lid operational position in the fluid passageway being operable to open and close fluid flow through the fluid passageway, comprising:

an upper member positionable within the fluid passageway;

a lower member positionable within the fluid passageway in position below the upper member;

a ring seal positioned between the upper member and the lower member, the ring seal being outward stretchable from an initial perimeter size to a sealing perimeter larger size than the initial perimeter size; and an actuator member movable to first and second operational positions, as the actuator member is moved from the second operational position to the first operational position with the lid in the lid operational position in the fluid passageway, the actuator member axially moves the upper and lower members together without moving the lower member vertically, and in response, the upper member stretches the ring seal outward from the initial perimeter size to the sealing perimeter size whereat the stretched ring seal is in fluid-tight sealing engagement with the inner body portion to close fluid flow through the fluid passageway when the lid is in the lid operational position in the fluid passageway, and as the actuator member is moved from the first operational position to the second operational position with the lid in the lid operational position in the fluid passageway, the actuator member axially moves the upper and lower members apart without moving the lower member vertically, and in response, the upper member allows the outwardly stretched ring seal to move inward from the sealing perimeter size to the initial perimeter size whereat the ring seal is out of fluid-tight sealing engagement with the inner body portion to open fluid flow through the fluid passageway when the lid is in the lid operational position in the fluid passageway.

* * * * *